US007803125B2

(12) United States Patent
Santos-Munne et al.

(10) Patent No.: US 7,803,125 B2
(45) **Date of Patent: *Sep. 28, 2010**

(54) WALKING AND BALANCE EXERCISE DEVICE

(75) Inventors: Julio Santos-Munne, Glenview, IL (US); Alex Makhlin, Chicago, IL (US); Ela Lewis, Chicago, IL (US); Michael Peshkin, Evanston, IL (US); David A. Brown, Evanston, IL (US); J. Edward Colgate, Evanston, IL (US); James L. Patton, Wilmette, IL (US); Benjamin L. Rush, Evanston, IL (US); Doug Schwandt, Palo Alto, CA (US)

(73) Assignee: Rehabilitation Institute of Chicago Enterprises, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/481,222

(22) Filed: Jun. 9, 2009

(65) Prior Publication Data

US 2009/0275867 A1 Nov. 5, 2009

Related U.S. Application Data

(62) Division of application No. 10/879,604, filed on Jun. 29, 2004, now Pat. No. 7,544,172.

(51) Int. Cl.
*A61H 1/00* (2006.01)

(52) U.S. Cl. ..... 601/5; 602/16; 602/19

(58) Field of Classification Search ..... 601/5; 602/5, 16, 19, 32; 2/465; 600/587; 605/5
See application file for complete search history.

(56) References Cited

U.S. PATENT DOCUMENTS

| | | | | |
|---|---|---|---|---|
| 5,174,590 | A | 12/1992 | Kerley et al. | |
| 5,288,130 | A | 2/1994 | Foster | |
| 5,466,213 | A | 11/1995 | Hogan et al. | |
| 6,536,544 | B1 | 3/2003 | Egawa et al. | |
| 6,616,456 | B1 | 9/2003 | Nalty et al. | |
| 7,150,048 | B2 * | 12/2006 | Buckman | 2/465 |
| 2002/0183655 | A1 * | 12/2002 | Zhang | 600/587 |
| 2005/0283906 | A1 * | 12/2005 | Summers | 5/86.1 |

OTHER PUBLICATIONS

Choon-Young Lee et al., "Development of Rehabilitation Robot Systems for Walking-Aid," Proc. 2004 IEEE International Conference on Robotics & Automation, New Orleans, Louisiana, pp. 2468-2473, Apr. 2004.

(Continued)

*Primary Examiner*—Michael A. Brown
(74) *Attorney, Agent, or Firm*—Drinker Biddle & Reath LLP

(57) ABSTRACT

A pelvic support unit is coupled to a base by a powered vertical force actuator mechanism. A torso support unit, which is affixed to the patient independently of the pelvic support unit, is connected to the base by one or more powered articulations which are actuable around respective axes of motion. Sensors sense the linear and angular displacement of the pelvic support unit and the torso support unit. A control unit is coupled to these sensors and, responsive to signals from them, selectively control the displacement actuator and articulation(s).

20 Claims, 18 Drawing Sheets

OTHER PUBLICATIONS

Choon-Young Lee, ETRI, Kaist, Rehab Robot for Walking Aid, from site: http://www.morpha.de/download/publications/IPA_PaperROMAN01_btg.pdf., Fig. 4, 2001.

Image of REHABOT, built by Johns Hopkins University, date unknown. from web site: http://www.biomech.jhu,edu/pre-project/rehab/rehabot.html.

Chong & Sankai, Image of exoskeleton walker, date unknown. Sogang University Precision Control Laboratory, Korea.

Image of LOKOMAT, believed to be Nov. 2001.

Images and Descriptions of the AutoAmbulator, by HealthSouth. Downloaded from the Internet. Jul. 2001.

* cited by examiner

WALKING AND BALANCE EXERCISE DEVICE

CROSS-REFERENCE TO RELATED PATENT APPLICATIONS

This patent application is a divisional of U.S. patent application Ser. No. 10/879,604, filed Jun. 29, 2004 now issued as U.S. Pat. No. 7,544,172.

GOVERNMENT LICENSE RIGHTS

The U.S. Government has a paid-up license in this invention and the right in limited circumstances to require the patent owner to license others on reasonable terms as provided for by the terms of Contract No. 70NANB3H3003 awarded by the U.S. Department of Commerce.

TECHNICAL FIELD OF THE INVENTION

The present invention relates in general to methods and apparatus for physical therapy, and in particular to a powered physical therapy device for assisting a patient in performing walking, balance and reaching tasks.

BACKGROUND OF THE INVENTION

Presently there are two approaches in which gait training is conducted: a fully manual approach and a device-assisted approach. In manual therapy the therapist uses a gait belt for the purposes of both preventing a patient from falling, and applying corrective forces during training. While this method is in common practice today, it suffers from the following problems: it is unsafe, awkward, frequently requires more than one therapist due to safety concerns (and hence expensive), difficult to sustain for a long time, and restricts sufficient access to the patient's legs.

Conventional devices used to assist therapists with gait training usually are variations of overhead body support systems (for example, LITEGAIT™ manufactured by Pro Med Products). These devices have not seen wide use because their uncomfortable harnesses and long setup times limit the duration of therapy sessions. In addition, their large, unwieldy frames restrict mobility of patients over the ground or floor and restrict device transport in a hospital setting.

Another conventional device, the LOKOMAT™ manufactured by Hocoma AG, is stationary, implements only one therapy approach (neurofacilitation) which involves repetitive movement of the legs within a specified kinematic pattern, and is primarily targeted to the spinal cord injury patient population. The trunk and pelvis is held stationary and the movements occur over a treadmill. Therefore, this device does not allow balance training, overground walking training or upper extremity practice during locomotion.

In view of these conventional devices, a need persists in the physical therapy field for a device which enhances safety, addresses balance in the context of gait training, allows practice with using the upper extremities, enhances patient mobility in a functional context of walking over ground, permits easy access by the therapist to the patient's legs, permits the physical therapist to challenge the patient in a safe manner, reduces setup time, and increases duration of therapy.

SUMMARY OF THE INVENTION

According to one aspect of the invention, a base of a physical therapy apparatus has coupled to it a pelvic support unit fittable to the patient and a torso support unit fittable to the patient. The pelvis support unit is coupled to the base through at least a first angular or translational articulation. The torso support unit is coupled to the base through a second articulation which is independent of the first articulation.

According to a further aspect of the invention, the physical therapy apparatus provided includes a frame which can travel over the floor or ground and an upstanding support arm affixed to the frame. A pelvis support unit is fitted to the pelvic region of the patient and has a powered actuator which selectively applies a vertical force to the pelvis support unit relative to the base. In one of its modes of operation, the pelvis support unit applies a force in opposition to the force of gravity, relieving a therapist-selected portion of the patient's weight. The apparatus further includes a torso support unit which is fitted to the torso of the patient at a position above the pelvis of the patient. The torso support unit includes a powered articulation about at least one axis relative to the base which is independent of the powered vertical actuator associated with the pelvis support unit. Sensors are associated with the pelvis support unit and the torso support unit, or the structures supporting them, to sense the spatial position and orientation of these units relative to the base and, preferably, one or more of the forces and torques applied to these structures. A control unit is coupled to the sensors, to the powered vertical actuator and to the powered articulation to selectively move the pelvis support unit and the torso support unit relative to the base.

Preferably, the patient wears a torso harness affixed to the torso support unit and a pelvic harness affixed to the pelvis support unit. These harness elements are preferably separate from each other.

In one embodiment, the control unit is able to apply a selected amount of torque in a selected angular direction around the torso unit axis of articulation. This torque, for example, could be used to completely or partially resist a patient torso's excursion away from an appropriate posture.

In another aspect of the invention, the torso support system's powered articulation actuates around at least two axes of motion, such as tilt in a sagittal plane and tilt in a coronal plane. Sensors are provided to sense angular displacement, and/or torques, in both directions, and the control unit can actuate the powered articulation(s) to correct any excursion away from an appropriate posture, or on the other hand can intentionally challenge the patient in order to improve balance. The present invention presents a host of choices to the therapist in conducting physical therapy relative to walking, posture, standing, reaching, and other activities involving the position and movement of the torso and pelvis. By way of further example and not by limitation, the apparatus may be used or programmed to exaggerate the patient's deviation from correct posture in order to train the patient to fight the other way, to train for the correct rhythmic movements associated with a walking gait, to apply constant torque irrespective of patient posture, or to follow the lead of the patient but apply damping forces to make the patient's movements feel safe to the patient.

According to a further aspect of the invention, in one embodiment the base is movable across the floor or ground using at least two powered wheel modules or units, which are actuated to both roll and steer independently of each other. The control unit can actuate the powered wheels in order to conform the position and orientation of the physical therapy exercise device to a direction of travel in which the patient intends to go. This patient intent can be deduced from signals coming from sensors associated with the torso and/or pelvis support units, which can be chosen to be of the type which encode displacement, force/torque or both. Other means for moving the base relative to the ground or floor can be used.

According to yet another aspect of the invention, a physical therapy exercise apparatus is provided in which a pelvic support is coupled to a base by a powered vertical linear displacement mechanism. The physical therapist is therefore enabled to relieve some or all of the patient's weight using the control unit and force sensors. Nonetheless, the pelvic support unit is freely articulable around the vertical axis and other axes in order to permit the kind of pelvic motion which occurs during a walking gait. In a one embodiment, the pelvic support unit is also transversely articulable in order to permit a degree of side-to-side pelvic movement; in the illustrated embodiment, this side-to-side articulation is accomplished by a lateral unit to which the pelvic support is joined. In one embodiment these articulations are effected by providing parallelogram linkages between the pelvic support unit and a lateral arm coupled to the base. Sensors are provided to sense the angular displacement of these pelvic unit articulations and/or forces or torques accompanying them, the signals resulting from which can be used by the control unit to take corrective action and/or change the direction of travel of the unit. A preferred embodiment of the invention enables the pelvic support unit to rotate around three axes of motion: Y (tilt or pitch), X (hike or roll), and Z (swivel or yaw). In a preferred embodiment at least motions around the X and Z axes are sensed. In alternative embodiments, one or more of these articulations may be actuated and controlled instead of being freely articulable or "floating".

In a preferred embodiment, the present invention provides a computer-controlled, servo-driven physical therapy aid designed to ensure a patient's safety during gait and balance training. The device has different features and modes of operation to assist the therapist in providing efficient gait and balance therapy to patients with a wide variety of disorders and levels of disability.

The device has several technical advantages over conventional apparatus and methods. First, a single therapist can conduct training without the assistance from other staff. Second, the device provides a responsive support system which permits natural body dynamics to occur during walking. This allows the patient to work on his or her balance as part of the exercise.

Third, the device permits the therapist to safely challenge the patient. Risk naturally occurs with balance. The patient can experience the onset of a fall and has to make necessary corrections in order to recover and continue walking. However, an unsuccessful recovery must not result in a potentially dangerous fall, and the present invention prevents this. Furthermore, because of the inherent safety of the apparatus the therapist can challenge the patient to a larger degree than would be possible in conventional practice.

Fourth, the present invention enhances efficiency in the delivery of therapeutic services. In order to make best use of the limited duration of a therapy session, it is important that setup time, such as harnessing the patient, be kept to a bare minimum. Otherwise there is a disincentive for the therapist to use the device. The present invention is designed to make transfer into the device, configuration of the device and harnessing the patient very brief.

Fifth, the overall design of the device enhances the therapist's access to the patient's legs. Therapists often like to grasp the patient's legs, feet, etc. to guide the patient. The therapist typically likes to sit beside the patient—on a stool or the like—as the patient is exercising. The present invention moves as much of the support device as is possible toward the rear of the patient and otherwise out of the way of the volume through which the therapist conventionally accesses the patient.

BRIEF DESCRIPTION OF THE DRAWINGS

Further aspects of the invention and their advantages can be discerned in the following detailed description, in which like characters denote like parts and in which.

DETAILED DESCRIPTION OF THE INVENTION

According to one aspect of the invention, a gait and balance trainer is provided which includes a body harness, a responsive support system and wheels. A patient wears a pelvis harness and a torso harness which are connected to the responsive support system, whose motion with respect to the ground is controlled by at least two of the wheels. The responsive support system is designed to accommodate back and pelvis movement during walking by means of several active and passive degrees of freedom. The purpose of this is to allow natural walking patterns as well as to incorporate balance training into the exercise. The device according to the invention is capable of maintaining proper posture for weaker patients and can support a therapist-selected amount of their body weight.

In one use, the present invention allows a patient's natural walking body dynamics to occur unimpeded while providing a safety mechanism. The present invention can be used by the therapist in many ways to modify the patient's motion.

Figure 2:
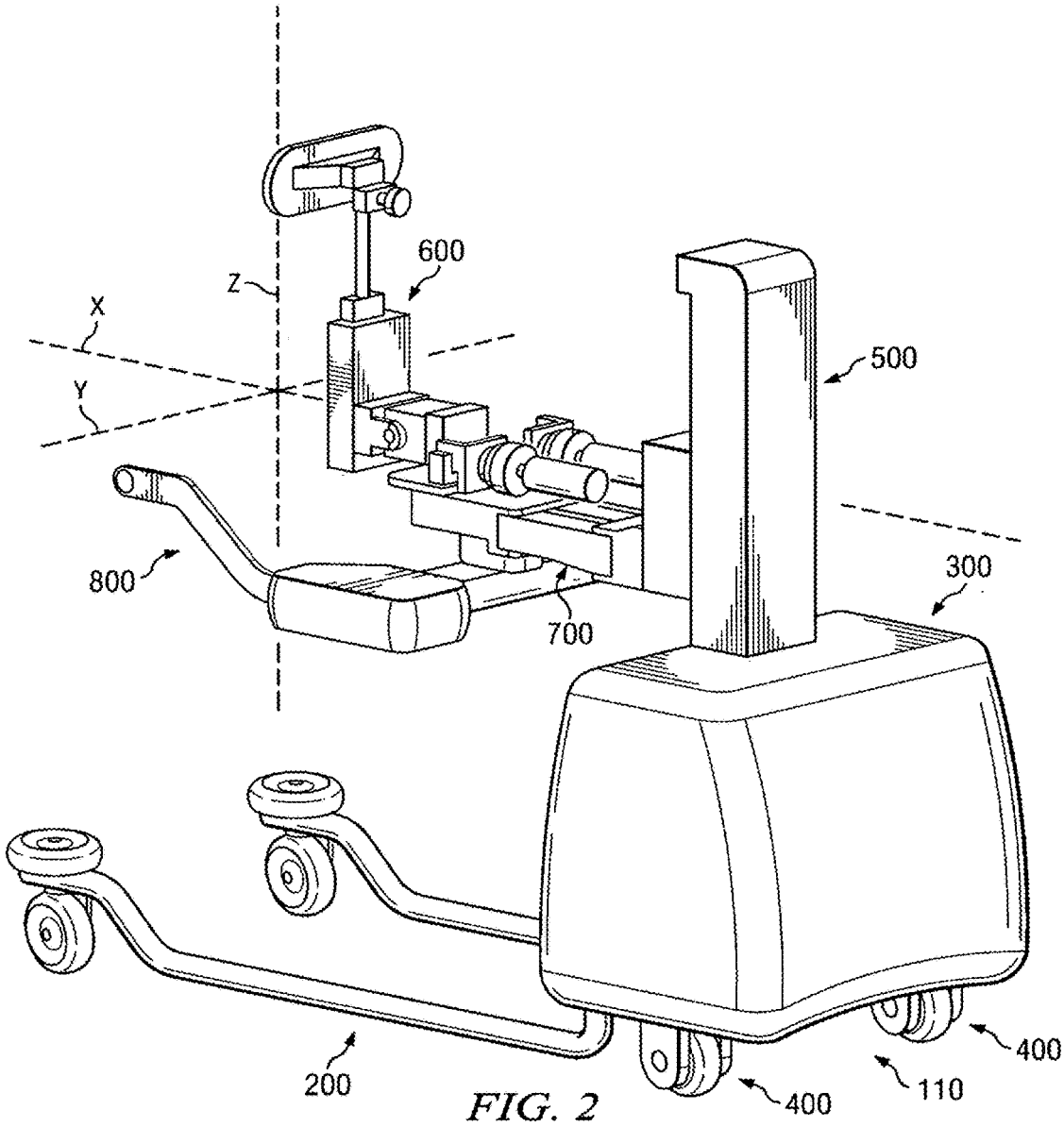
FIG. 2 is an isometric view of the device shown in FIG. 1, taken from another angle.
Figure 3:
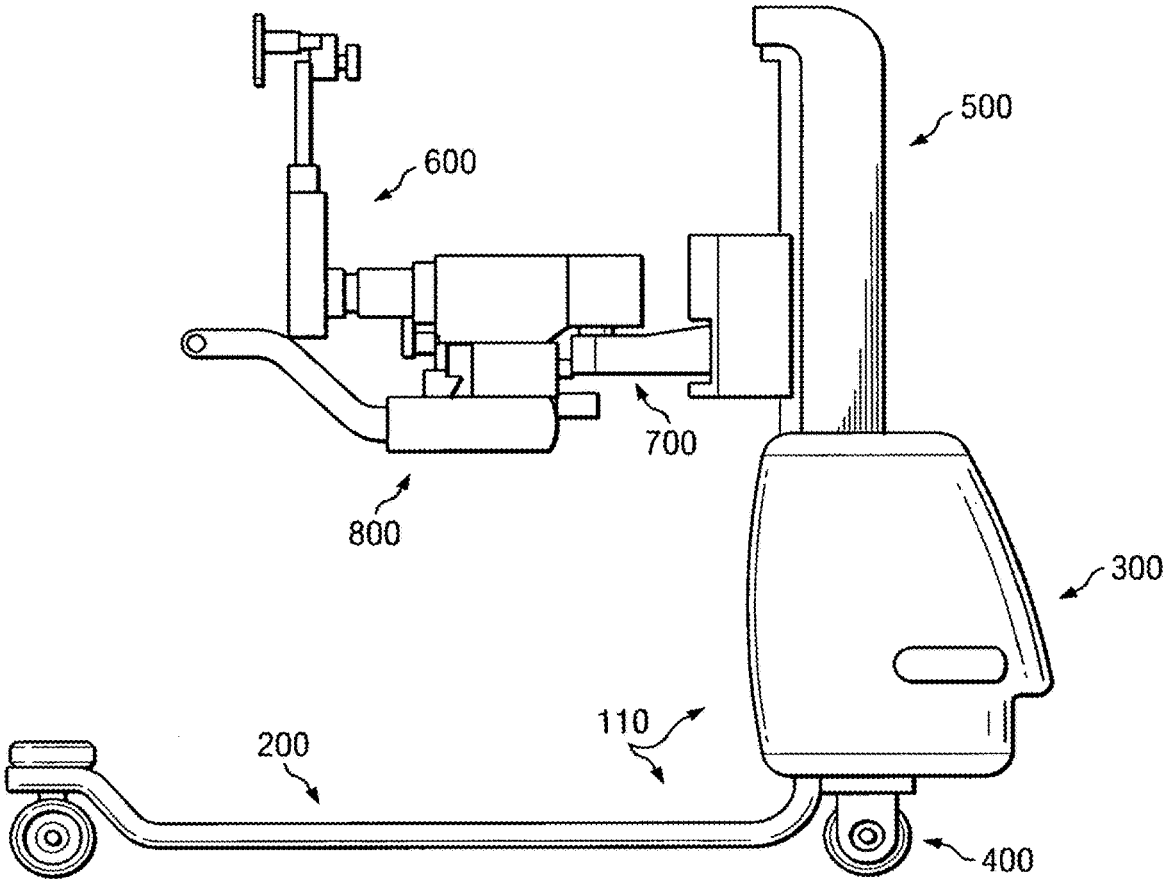
FIG. 3 is an elevational view of the device shown in FIGS. 1 and 2.

In the description below, the following coordinate system is used, as superimposed on FIG. 2. The X axis is front-to-back and is normal to a coronal plane containing the Y and Z axes. The Y axis is lateral, transverse or side-to-side and is normal to a sagittal plane containing the X and Z axes. The Z axis is vertical and is normal to a transverse or horizontal plane containing the X and Y axes.

Referring first to FIGS. 1-4, the relationship of the major components of the first illustrated embodiment of the invention, and their relationship to a patient and a patient's harness, will be described. In this illustrated embodiment, a device 100 according to the invention is comprised of a base 110, which in turn includes a frame 200, and a support arm or column 500 which is fixedly attached to and extends upwardly from the frame 200. Device 100 further includes a lateral unit 700 which is supported by and is movably attached to the support arm 500, a pelvis unit 800 attached to and supported by the lateral unit 700, and a torso unit 600 that is also attached to and supported by the lateral unit 700. While in the illustrated embodiment torso and pelvis units 600, 800 are both supported by a single lateral unit 700, in other embodiments they could be supported by separate cantilever structures projecting out from column or support arm 500, and could also be supported by separate vertical support arms.

As will be below described, a preferred embodiment of the device 100 is capable of moving about on the floor or ground in concert with the travel of a patient P. In the illustrated embodiment, this locomotion is provided by two geared driving wheel modules 400 attached to and supporting the rear of frame 200. The illustrated embodiment includes on-board sensor and control electronics 301, and these can be housed in an electronic enclosure 300 mounted to the frame 200. A separate stool 102 may be provided for the physical therapist.

In the illustrated embodiment, the frame 200 may move over the ground or floor in any planar direction, including translation and rotation. These planar movements are made possible by selective actuation of the wheel modules 400.

Support arm 500 applies a physical therapist-selected or -programmed amount of vertical lifting force to the patient P. The lateral unit 700 permits movement of the patient P from side to side. The pelvis unit 800 holds the patient securely through a pelvis harness 104. Pelvis unit 800 applies lifting forces to the patient's pelvis, while at the same time allowing motions of the patient's pelvis consistent with walking and balance. The torso unit 600 holds the patient P's upper body securely while allowing motions of the upper body which are consistent with walking and balance. A torso harness 106 is used to affix the torso unit 700 to the patient P's upper body, and preferably is physically separate from pelvis harness 104.

In one embodiment harnesses 104, 106 are permanently attached to their respective pelvic and torso support systems 800, 600. Harnesses 104, 106 may be formed in whole or part by various fabrics and may include various kinds of padding materials and/or inflatable sections as are known in the art.

Figure 5:
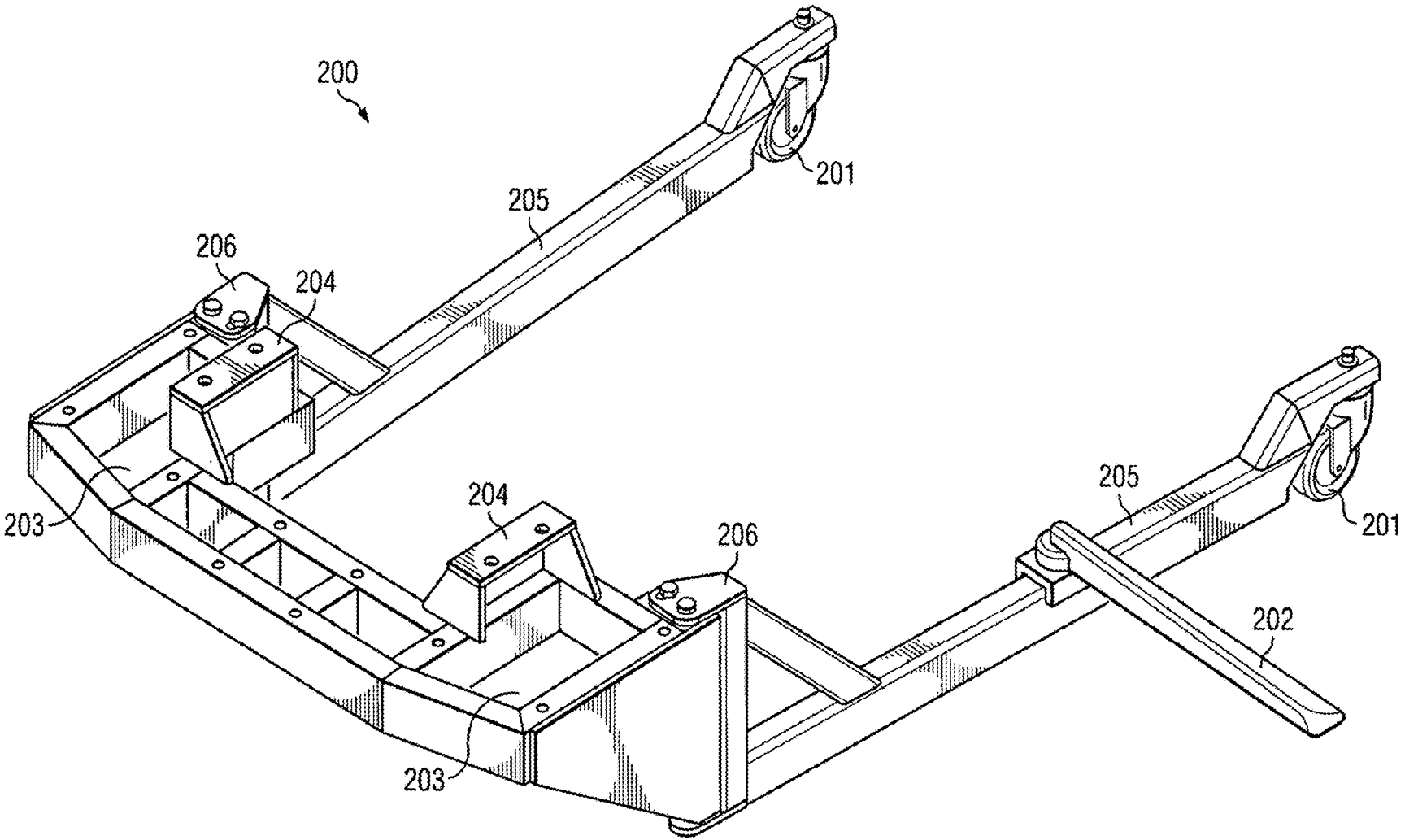
FIG. 5 is an isometric view of a frame unit which makes up a portion of the device shown in FIG. 4.

Referring to FIG. 5, in the illustrated embodiment the frame 200 includes wheels 201 which are rotatably affixed to the ends of respective outrigger arms 205. Wheels 201 preferably are of the caster type, but may also be of other omnidirectional type. While in other embodiments wheels 201 may be driving wheels that aid in moving the device 100 over the floor or other horizontal surface, in the illustrated embodiment the wheels 201 are "idler" wheels that conform to the lateral movement of the device 100 produced by rear driving wheel modules 400. In alternative embodiments wheels 201 may be lockable into certain orientations, or may be fixed to move forward only. In certain alternative embodiments of the invention, such as a balance-only device or a device meant to be used in conjunction with a treadmill, wheels 201 may be locked or replaced with pads.

Figure 4:
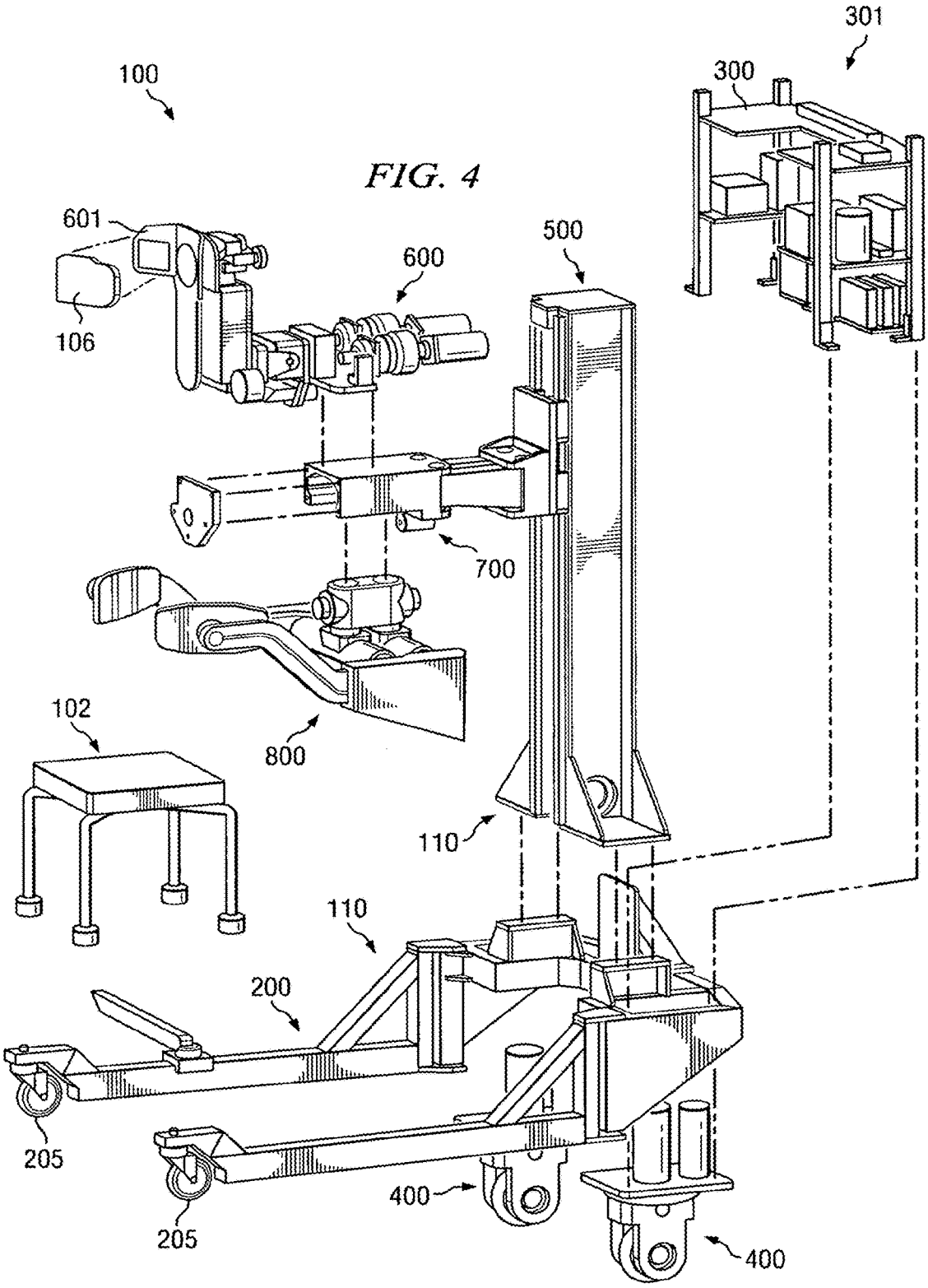
FIG. 4 is an exploded view of an embodiment of the device similar to the embodiment shown in FIGS. 1-3, with padding and covers removed in order to show further detail.

Frame 200 may include a stool attachment point or bar 202, which is capable of pulling/pushing along the physical therapist's stool 102 shown in FIG. 4. Attachment plates 204 receive support arm unit 500. Attachment receptacles 203 receive respective wheel modules 400. A rotatable and lockable mechanism 206 permits outrigger arms 205 to be spread apart from the illustrated parallel position to an angled-apart position, as might be useful as an aid for inserting a patient and/or a wheel chair. The ability to spread apart the outrigger arms 205 also allows the patient to perform balance exercises that require side stepping while maintaining the mobile base 110 in a fixed location.

Figure 12:
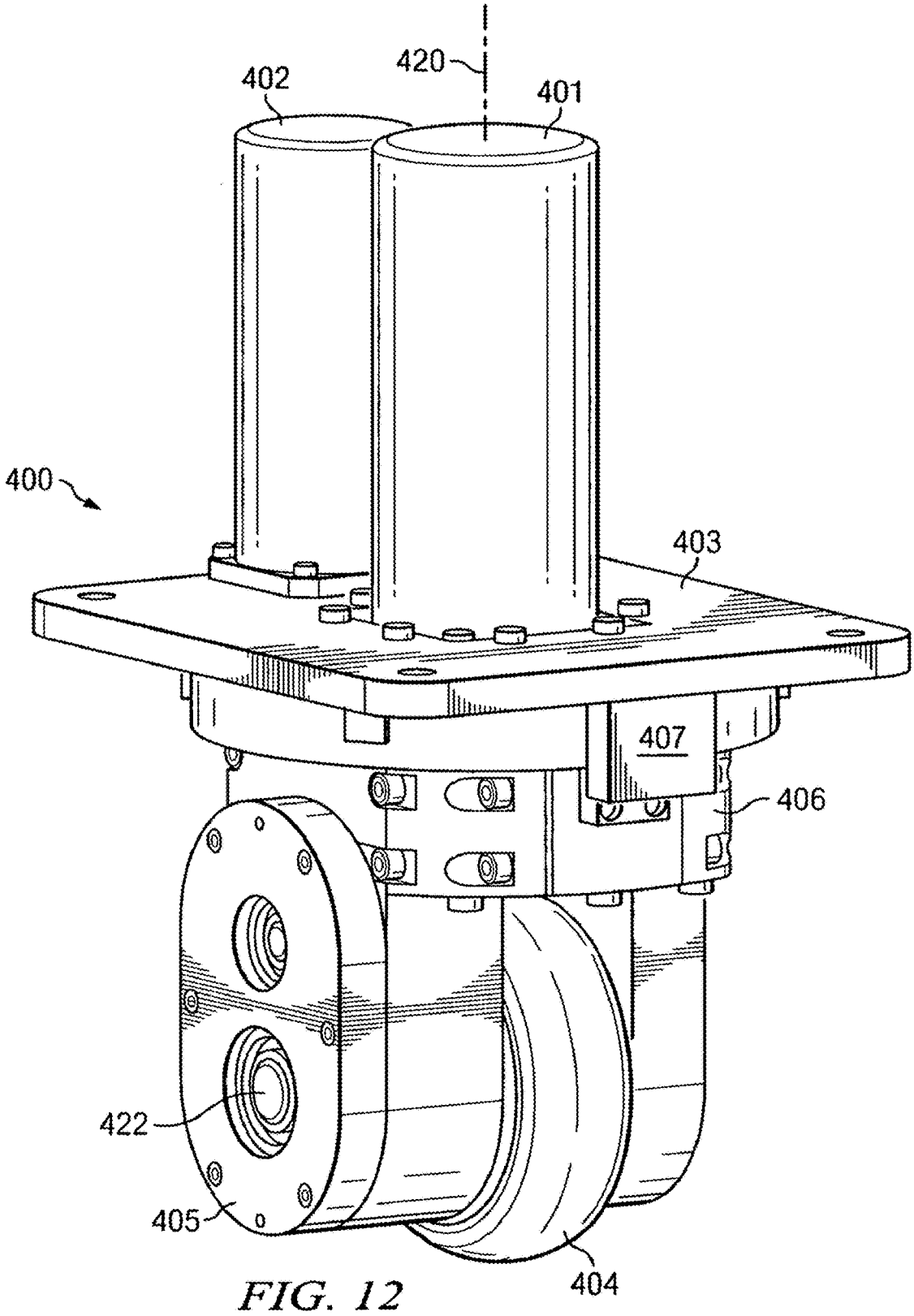
FIG. 12 is an isometric view of an assembled motorized wheel module for use with the invention.

Referring to FIG. 12, each driving wheel module 400 includes a rolling wheel 404 which may be steered about a vertical axis 420, and which is also driven in either a forward or reverse rolling direction. An attachment plate 403 is used to affix the wheel module 400 to a respective attachment receptacle, point or plate 203 on the frame 200.

An assembly 406 rotates about axis 420, carrying with it and thereby steering wheel 404. A steering motor 402 controls the planar orientation of wheel 404 by moving the rotating assembly 406. A drive motor 401 selectively imparts rotational force to the wheel 404, which is illustrated in more detail in FIGS. 13 and 13A. The action of steering motor 402 is communicated to the rolling axis 422 of the wheel 404 by gearing within a gear housing 405, which is illustrated in more detail in FIGS. 13A and 13B.

Figure 13:
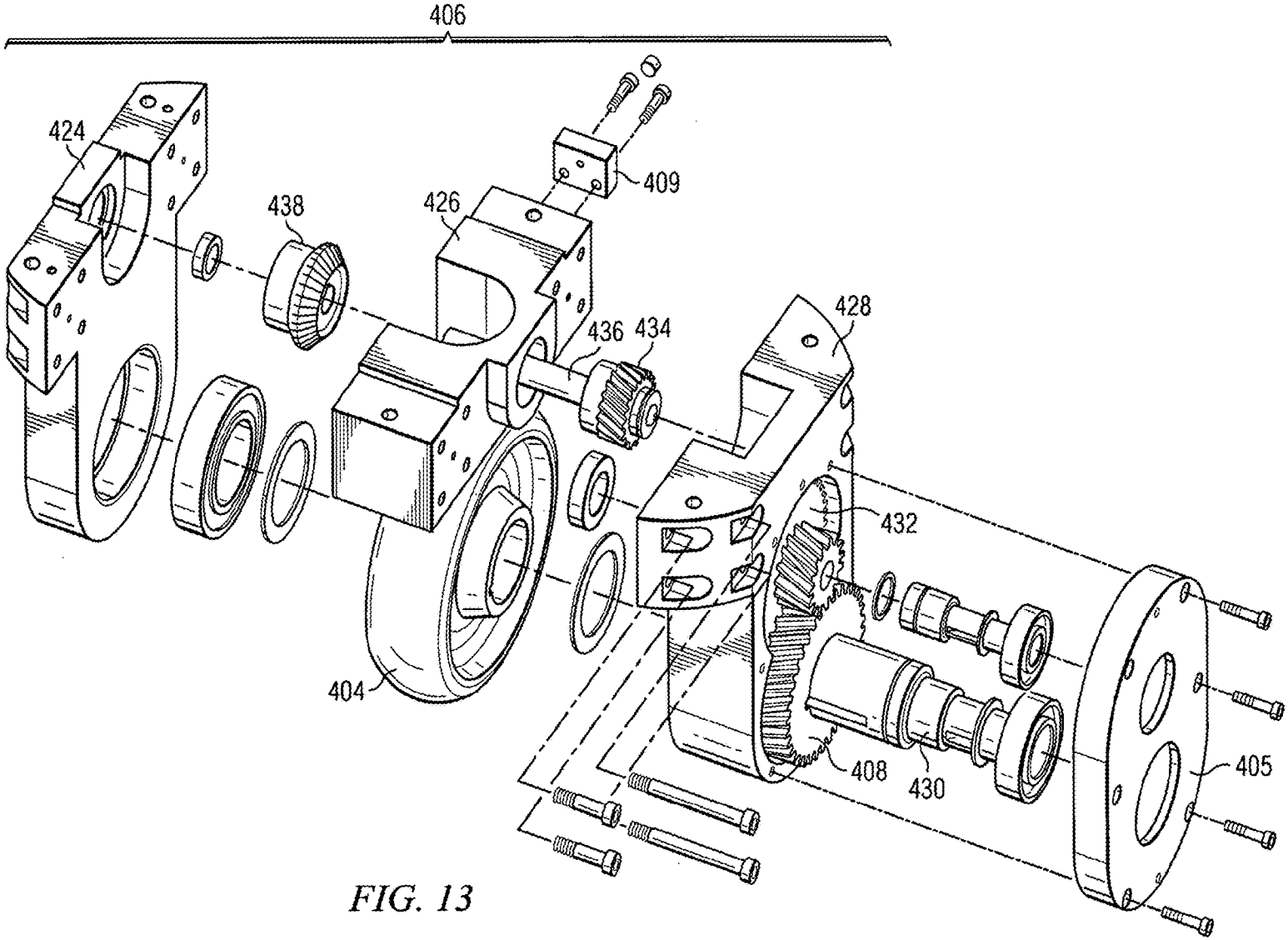
FIG. 13 is an exploded isometric view of a lower part of the motorized wheel module shown in FIG. 12.
Figure 13A:
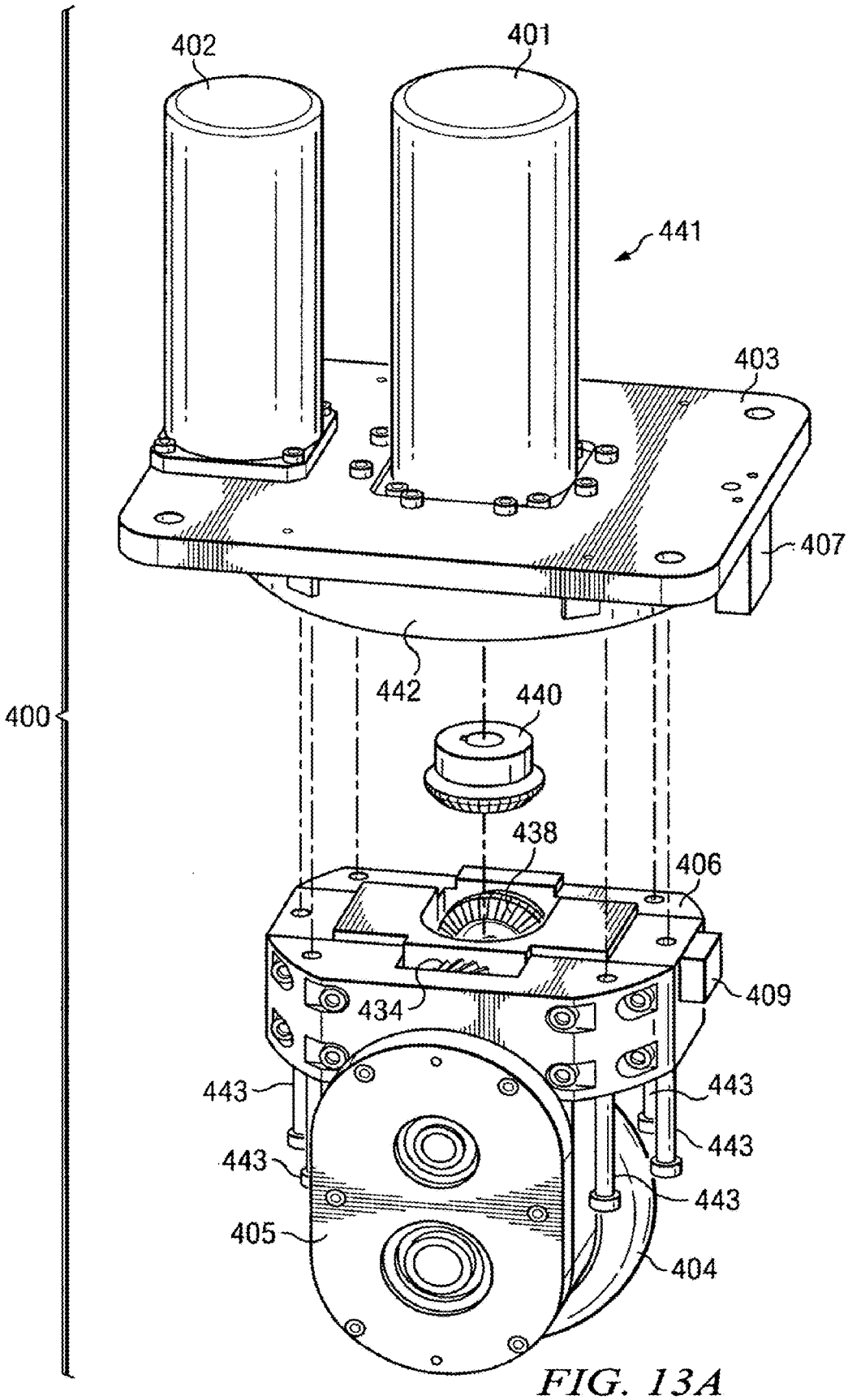
FIG. 13A is a further exploded isometric view of the motorized wheel module shown in FIG. 12, showing cooperation between drive motors and driven wheel housing.

Referring to FIGS. 13 and 13A, the assembly 406 in the illustrated embodiment includes a left (according to the view in FIG. 13) plate 424, a top block 426 and a right plate 428. A wheel rotating gear 408 is mounted on the axis of wheel 404 and imparts rotational force to the wheel 404 through a shaft 430. Wheel gear 408 is driven by a gear stage 432, which in turn is driven by a gear 434 on a shaft 436 parallel to the wheel axis. Coaxial with the gear 434 is a bevel gear 438 that communicates with vertically oriented gear 440 which is mounted on the shaft of motor 401.

Figure 13B:
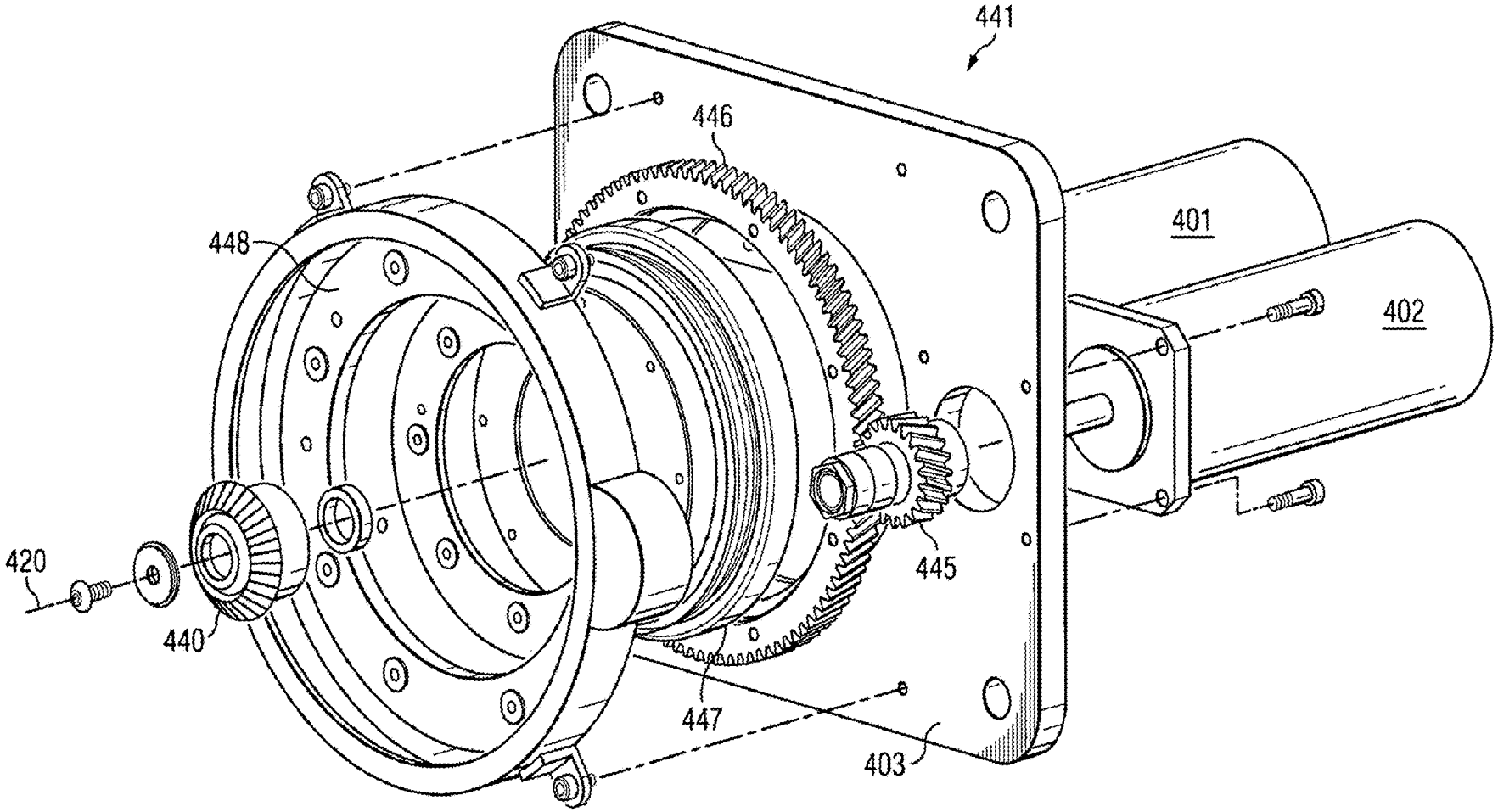
FIG. 13B is a further exploded isometric view of an upper part of the motorized wheel module shown in FIG. 12.

Referring to FIGS. 13A and 13B, the assembly 441 in the illustrated embodiment includes a fixedly mounted plate 403 and a rotating plate 448. A rotating gear 445 is mounted on the shaft of steering motor 402 which imparts rotational force to plate 448 via rotating gear 446 which in turn is mounted on steering axis 420. Rotating gear 446 rides on an outer race of a bearing 447 and is fastened to plate 448 via screws. Steering motion is imparted to the subassembly 406 via the fastened connection to rotating plate 448 using screws 443.

In the illustrated embodiment, the rolling angular velocity and the steering angular velocity (around axis 420) of wheel 404 are both measured by rotational encoders (not shown) built into respective motors 401 and 402. These encoders are kinematically coupled to the rolling and steering wheel velocities of wheel 404 by the gear trains above described. The coding signals give incremental information only, which is sufficient to determine rolling velocity, but not completely sufficient for steering motion. To control the steering of device 100 it is necessary in this embodiment to determine the absolute steering orientation of wheel 404. This is accomplished by a hall switch 407 on the upper housing 422 and a magnet 409 mounted on housing 406 (FIG. 13A), which provides an indexing pulse to the electronics or control unit 301 (later described).

Figure 6A:
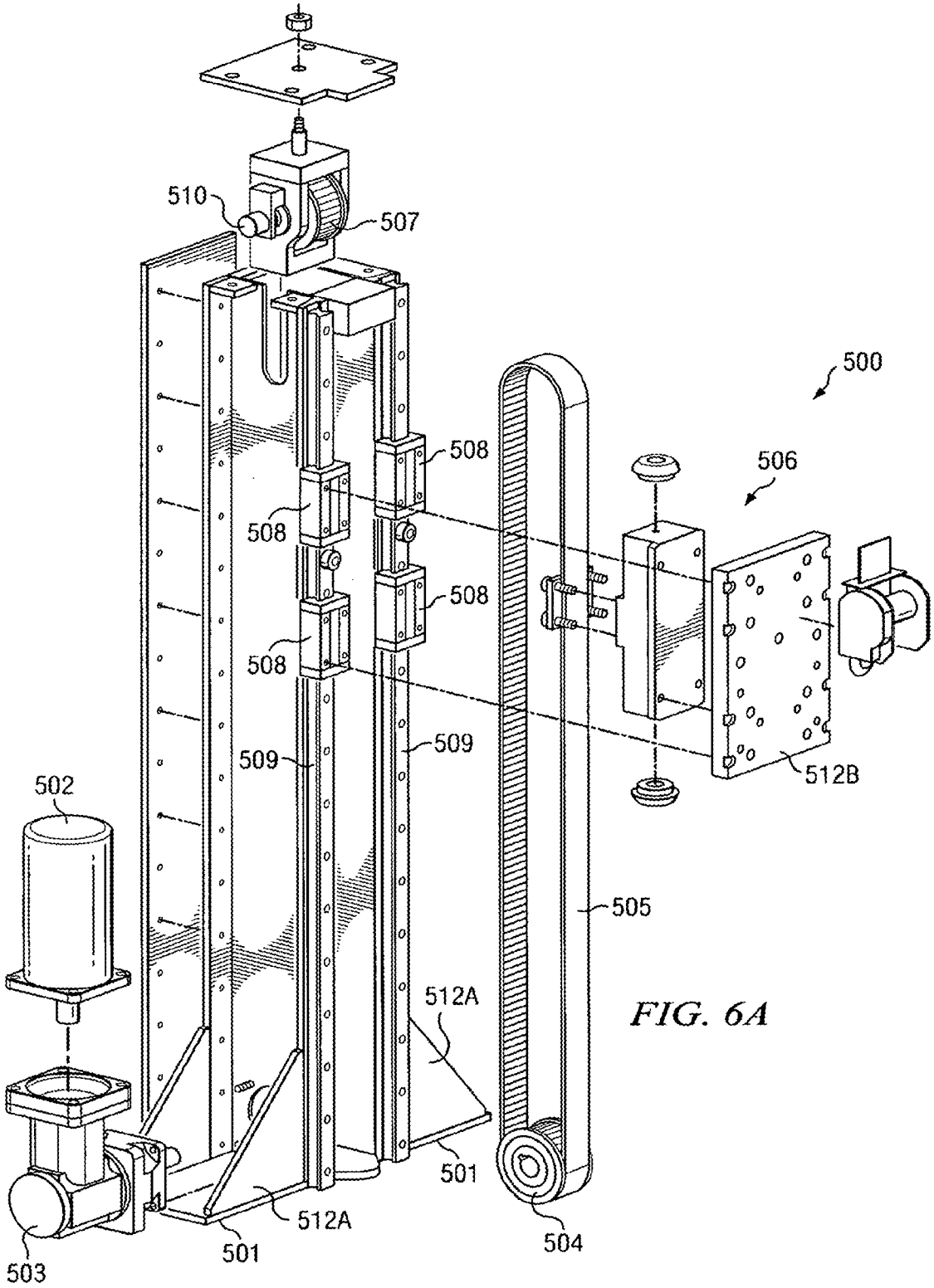
FIGS. 6A and 6B are exploded and assembled isometric views, respectively, of a support arm forming a component of the device shown in FIG. 4.
Figure 6B:
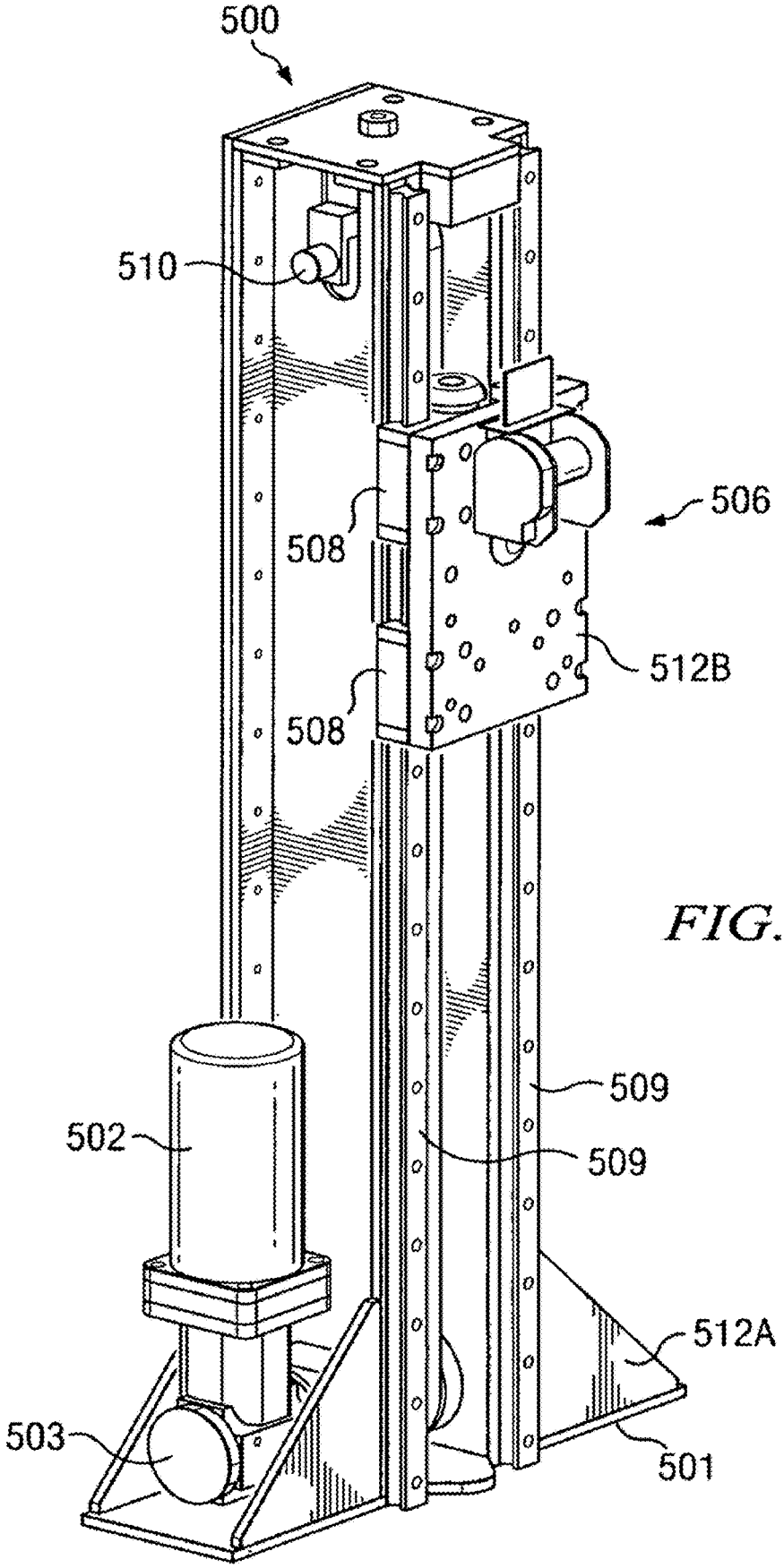

In FIG. 6A, the support arm is shown in an exploded isometric view, while FIG. 6B shows the support arm 500 in an assembled condition. A mounting flange 501, as reinforced by gusset plates 512, is used to mount the support arm 500 to the support arm receiving plates 204 of frame 200 (FIG. 5). A motor 502 rotates a toothed pulley 504 via reduction gearing 503. A vertically oriented, toothed endless drive belt 505 is mounted around the driving pulley 504 and a corresponding upper driven pulley 507, mounted at or near the top of the support arm 500. Motor 502 is actuated by signals from electronics module 301.

A lateral unit carrier assembly 506 is affixed to an outer portion of the belt 505 so that it is vertically displaced upon the movement of belt 505, either upward or downward. In this illustrated embodiment, the carrier assembly 506 is confined to a vertical axis of motion by four linear slide units 508, which slide on a pair of vertically oriented, parallel slides 509. The velocity and position of the lateral unit carrier 506 are sensed using an incremental encoder (not shown) incorporated into the belt driving motor 503, in combination with a multi-turn potentiometer 510, the latter of which is an absolute sensor.

Figure 7:
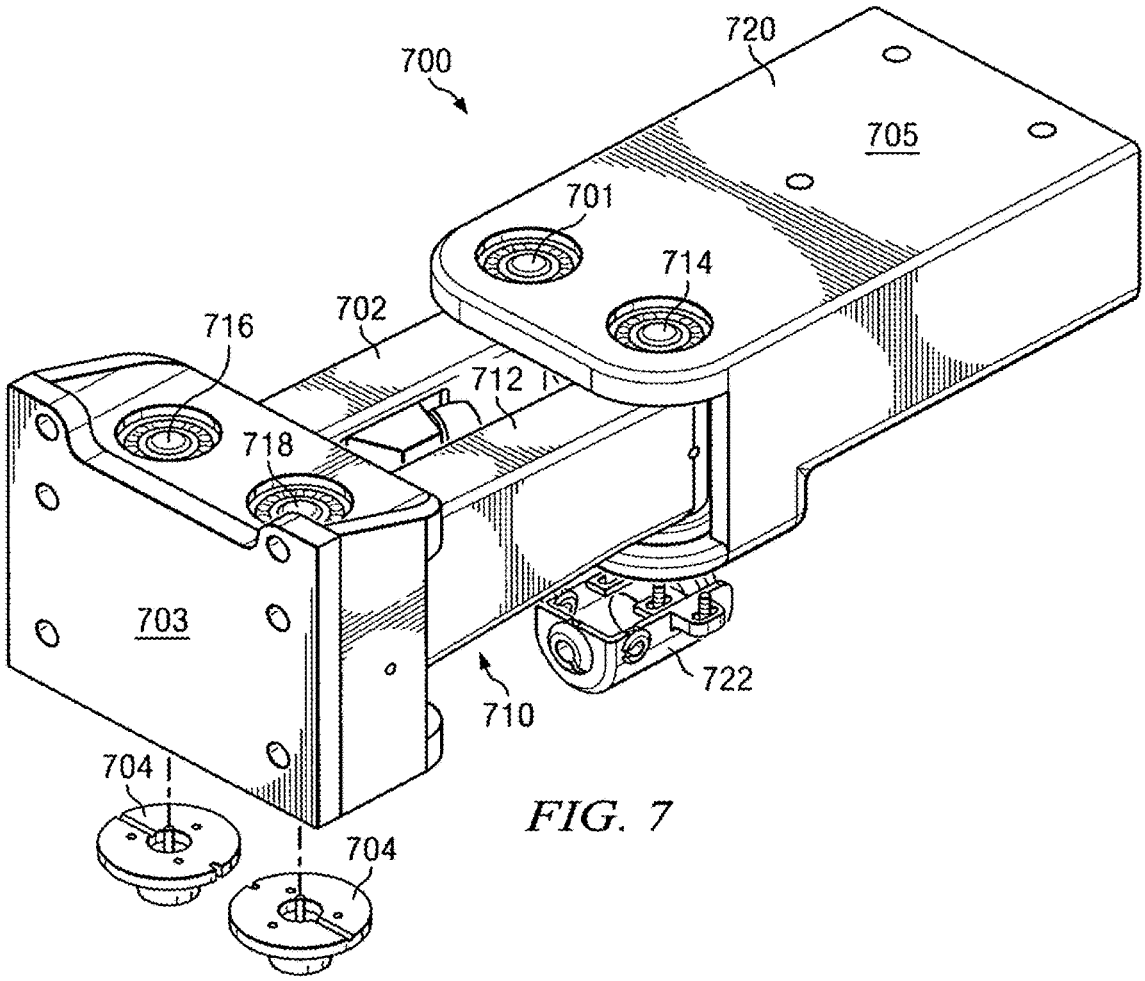
FIG. 7 is an isometric view of a lateral unit forming a structural component of the device shown in FIG. 4.

The carrier 506 has a vertical face plate 512 to which a vertical plate 703 of the lateral unit 700 is affixed (FIG. 7). The lateral unit 700 allows free side-to-side motion of the patient P while the patient P is walking, balancing or reaching. A laterally translatable attachment 705 of the lateral unit 700 supports, in the illustrated embodiment both the pelvis unit 800 and the torso unit 600. The lateral unit 700 includes a parallelogram linkage 710 which includes lateral parallel bars 702 and 712 and bearing sets or pivots 701, 714, 716 and 718.

Figure 1:
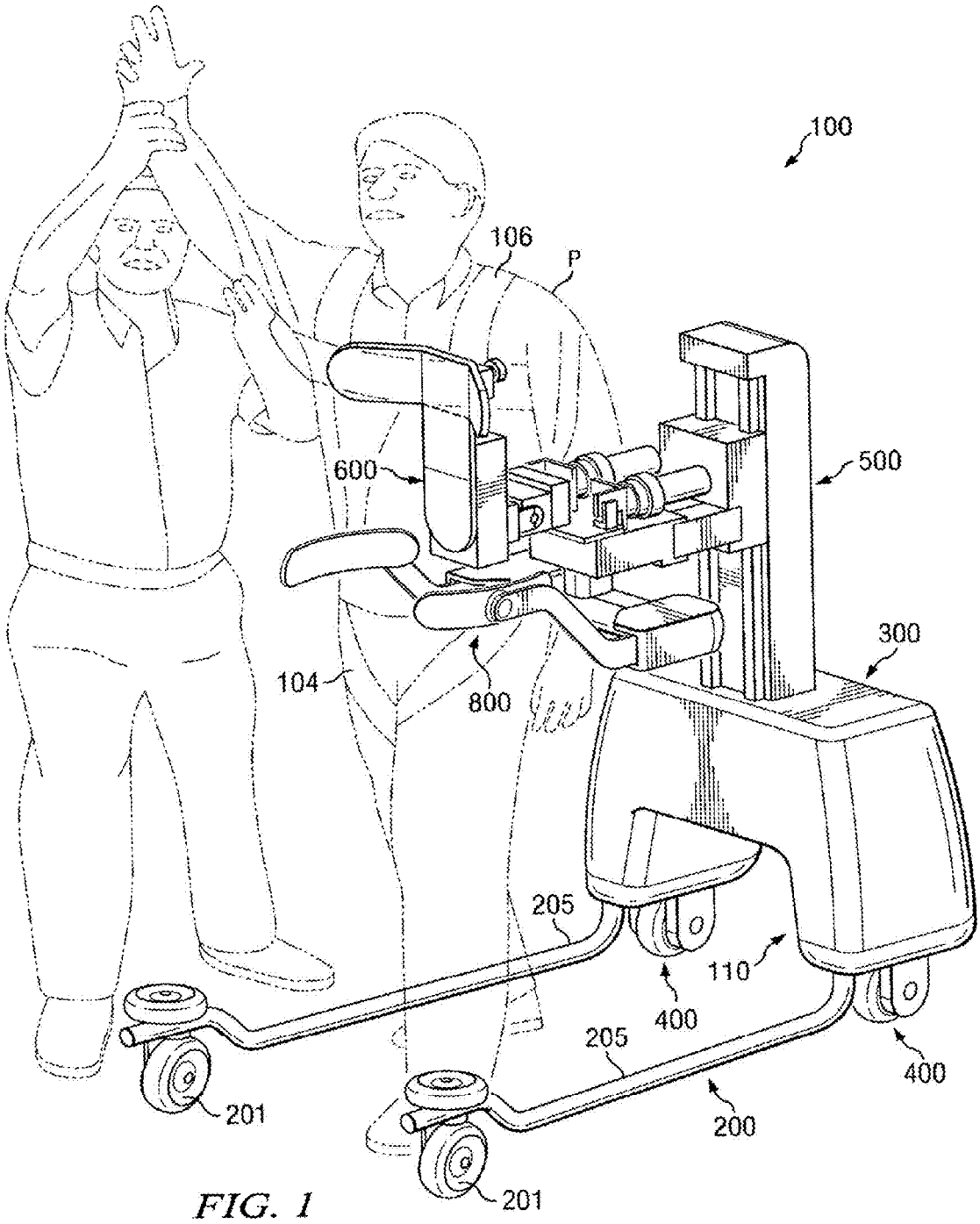
FIG. 1 is an isometric view of a walking and balance exercise device according to the invention, with a patient and harness shown in phantom and hip pads and patient motion sensors removed for clarity.
Figure 9:
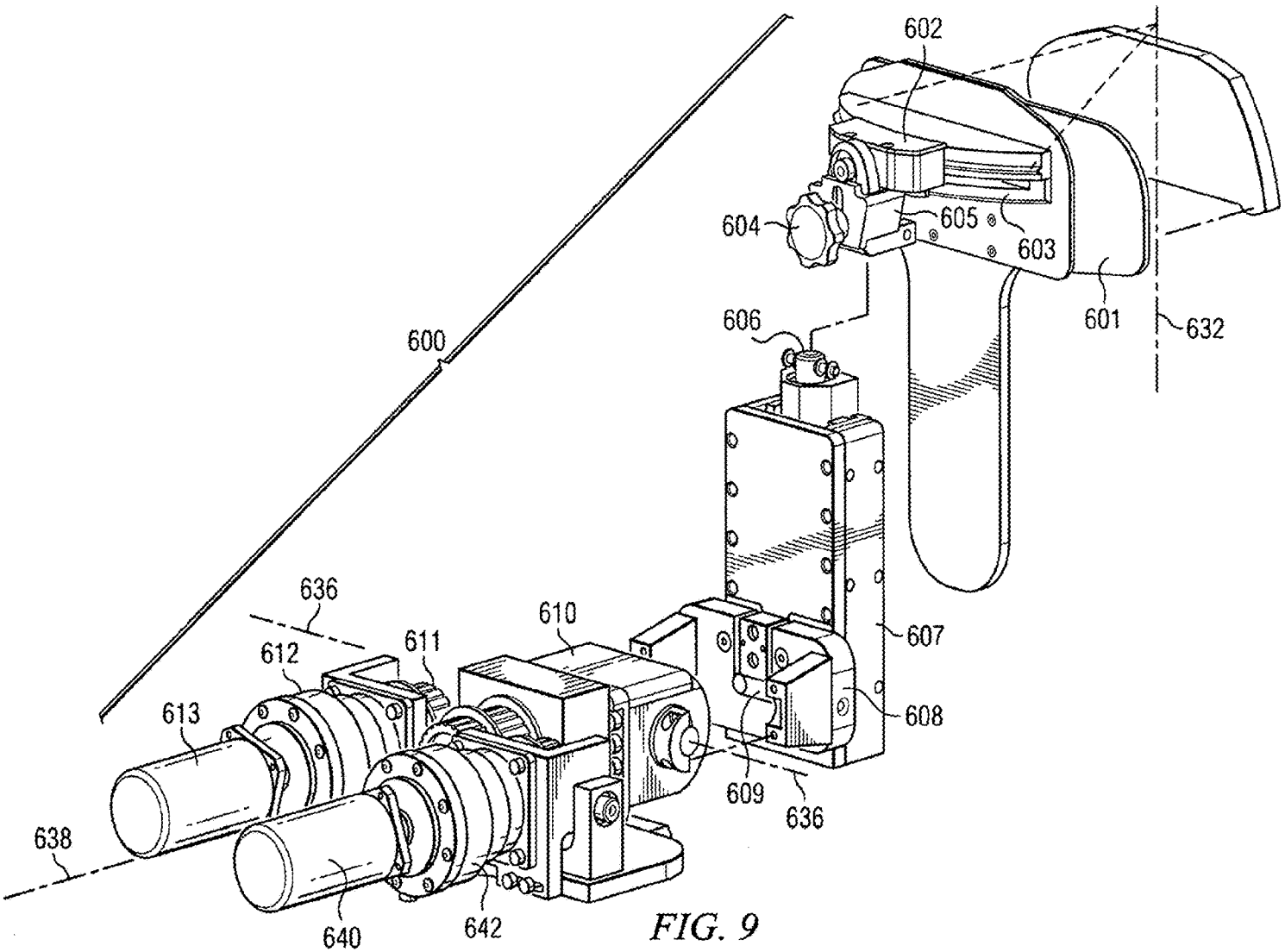
FIG. 9 is an exploded isometric detail of a torso unit of the embodiment shown in FIG. 4.
Figure 10:
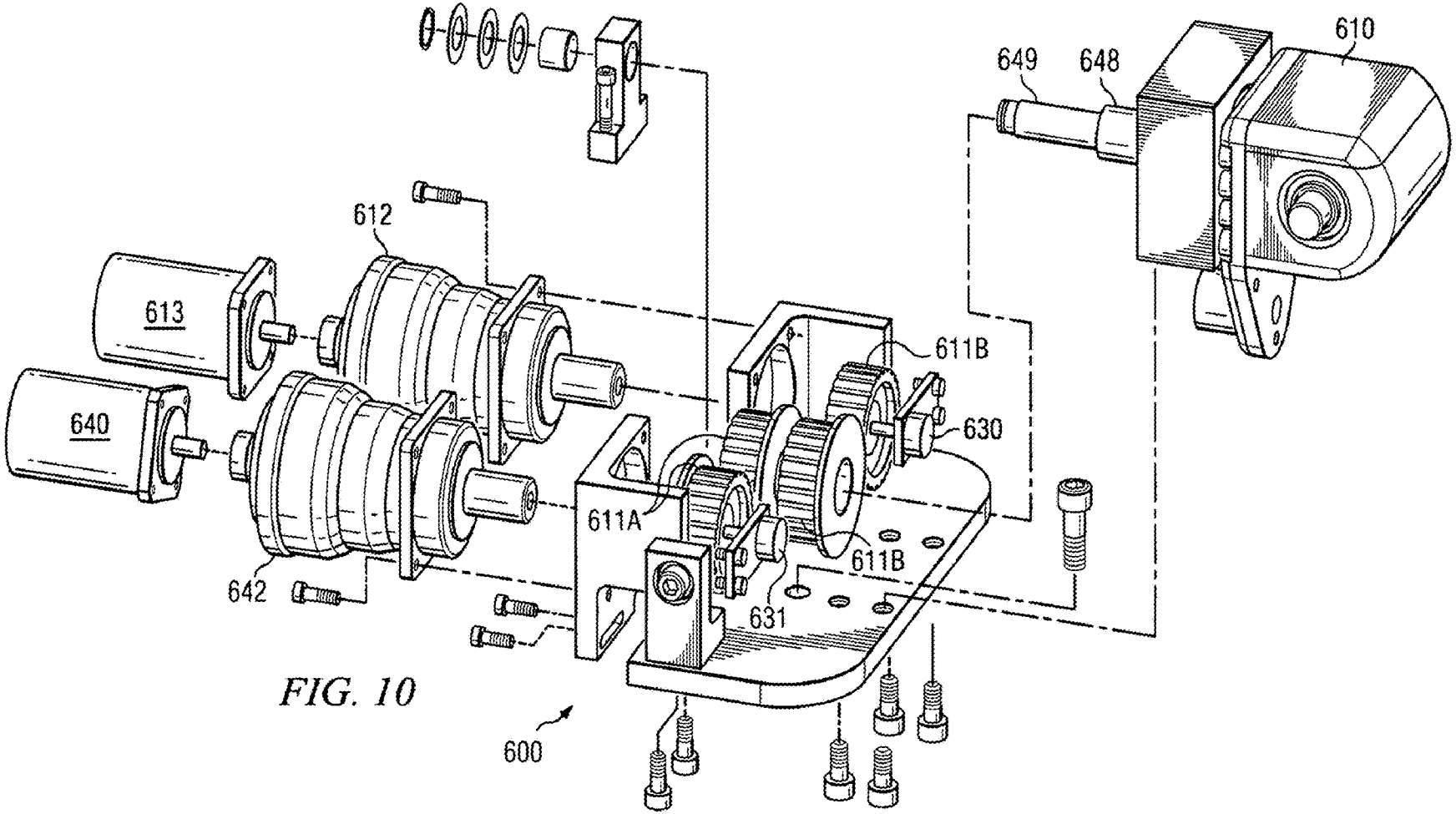
FIG. 10 is an exploded isometric detail of a portion of FIG. 9, showing pulleys and other transmission components of the torso unit.
Figure 11:
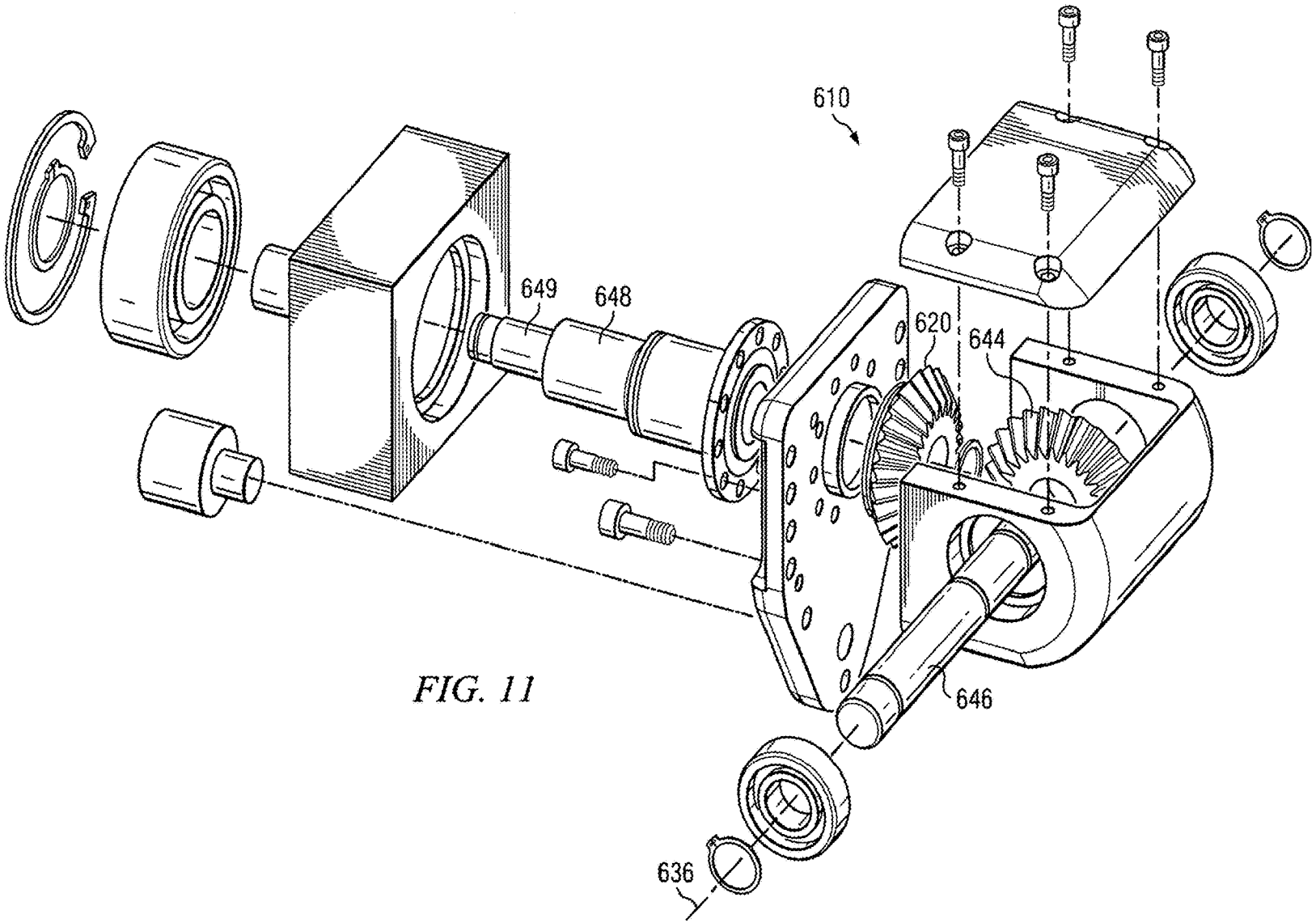
FIG. 11 is an exploded isometric detail of a portion of FIG. 10, showing gearing and other transmission components of the torso unit.

In the illustrated embodiment, the motion of the parallelogram linkage 710 is not actuated by any motor or other driver, but rather is passive and moves responsive to forces created by the patient P. While the parallelogram linkage 710 is not actuated, its angular position is nevertheless sensed by potentiometers 704, which is used by control unit 301 to sense the lateral displacement of the patient. Attachment block 705 has an upper face 720 which carries the torso unit 600, which is illustrated in FIGS. 9-11. As shown in FIG. 1, the torso unit 600 carries a torso harness 106 which is fitted to the patient P's upper torso. The torso harness 106 is attached to a torso harness plate 601.

A first axis of motion allowed to patient P's torso is to rotate about a vertical axis. This rotation is allowed by a revolute slider 602, which slides along and is captured by a convexly arcuate rail 603. Optionally a locking screw 604 can be tightened to prevent rotation of the torso harness plate about an axis 650, or therapist-adjustable stops (not shown) can be placed in rail 603 to prevent rotation of slider 602 beyond predetermined angular limits. A vertical axis of rotation 632 around which slider 602 and harness unit 601 articulates is selected to approximate an axis passing through patient P's vertical center of rotation. A potentiometer (not shown) mounted to slider 602 reads an angle of rotation around this vertical axis 632.

The revolute slider 602 is attached to a bracket 605. The bracket 605 attaches to a telescoping column 606. Column 606 incorporates a length sensor (not shown) which in one embodiment can be a string potentiometer, an example of which is sold by Space Age Control Inc. of Palmdale, Calif. This length sensor measures the amount of column 606's extension.

The telescoping column 606 slides within a housing 607 which in turn is supported by a plate 608. The plate 608 includes torque measuring apparatus, implemented in the illustrated embodiment by strain gauges (not shown) at location 609. The strain gauges measure two axes of torque created by movement of the patient and communicated through sliding column 606. These two axes of torque are about the X and Y axes. In the illustrated embodiment, the torque about a vertical or Z axis is not measured, although instrumentation easily could be provided for this measurement. The torque measuring apparatus is supported by an assembly 610 which is rotatable about two axes 636 and 638. The assembly 610 is driven by pulleys 611A, which are turned by motors 613, 640 via gear reduction units 612 and 642.

FIG. 10 shows a portion of the torso unit 600 in more detail. Potentiometers 630 and 631 are attached to pulleys 611A and 611B in order to measure the rotational angles of the pulleys 611A and 611B and, because of the kinematic connection of the pulleys 611A and 611B to the telescoping column 606, potentiometers 630 and 631 also serve to measure the angles of column 606.

FIG. 11 is an exploded detail view of the assembly 610. A bevel gear 644 is mounted on a transverse shaft 646, which is coaxial with rotational axis 636 and permits/causes sliding column 606 to rotate in a sagittal plane. Driven bevel gear 644 is driven by a bevel gear 620 that is mounted to a shaft 649. Shaft 649 communicates through pulley pair 611A and reduction gearing 642 to motor 640. Likewise shaft 648 connects to housing 610, which is coaxial with rotational axis 638 and permits or causes the sliding column 606 to rotate in the coronal (frontal) plane. The shaft 649 communicates through pulley pair 611B and reduction gearing 612 to motor 613.

Thus, the torso harness 106 which attaches to patient P may freely move in the direction allowed by the telescoping column 606, and may be actively controlled in two axes of rotation by the torso unit motors. The angle and torques associated with the torso harness 106 are measured and may be used by electronics 301 in assessing how the device 100 should be controlled.

Figure 8:
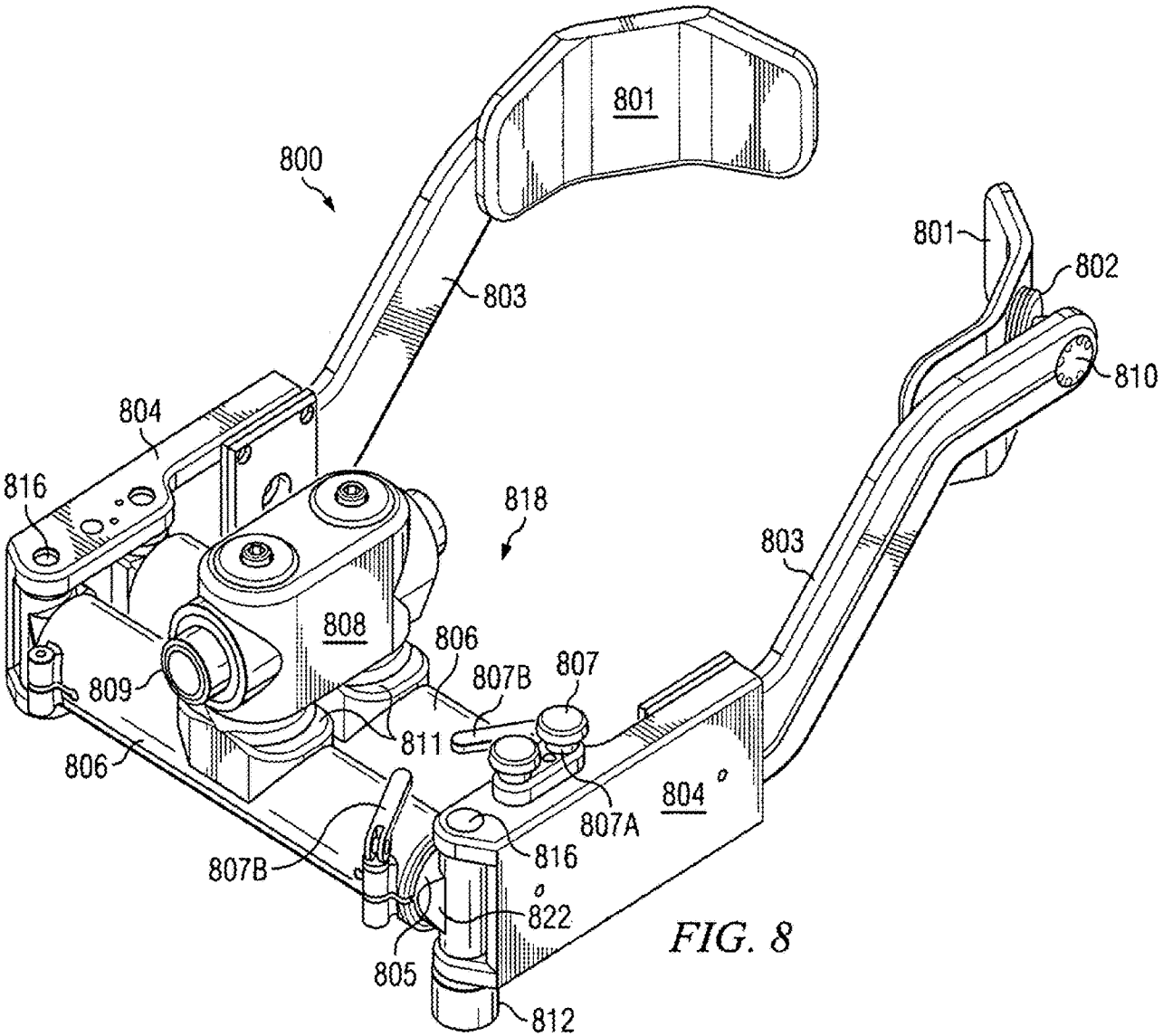
FIG. 8 is an isometric view of a pelvis unit forming a structural component of the device shown in FIG. 4.

In the illustrated embodiment, the lateral unit attachment block 705 also carries the pelvis unit 800, which in the illustrated embodiment is attached to an underside of the attachment block 705 (FIG. 7). A potentiometer 722 measures the rotation of the entire pelvis unit around a pelvis unit attachment shaft 809. Referring to FIG. 8, this pelvis unit attachment shaft 809 extends from a housing 808. Housing 808, together with parallel transverse rods 806 and elongate, substantially vertically oriented end plates 804, constitute a parallelogram linkage 818 such that extended arms 803 will move in the same angular direction. Rods 806 articulate with end plates 804 at pivots 816 (two shown) and 807 (one shown).

The housing 808 includes bearings 811 that each have a substantially vertical axis of rotation, thereby permitting rods 806 to slide in parallel to each other and permit the articulation of parallelogram linkage 818. The motion of the parallelogram linkage 818 translates extending arms 803 such that when one of the arms 803 moves forward, the other arm 803 moves backward. Each arm 803 attaches via a respective ball joint 802 to a respective pelvis cuff 801 which conforms to a respective side of the patient's pelvis, and also to pelvis harness 104 (FIG. 1). The ball joint 802 allows three axes of rotation, and is instrumented by a respective force sensor 810 which projects through arm 803 and which senses force vectors on two axes.

The extending arms 803 attach, at their proximal ends, to the parallelogram linkage end plates 804. The end plates 804 are adjustable relative to their separation distance from each other to accommodate patients of different pelvic widths. To accomplish this adjustment the end plates 804 can be telescoped into the ends 805 of the rods 806, tubular shaped extensions 822 being provided for this purpose which extend from and pivot around pivots 816 and 807. The end plates 804 can be swung open by removing pins 807A and rotating about pivots 816 in order to allow a patient to be transferred into position by approaching the device 100 from the side.

A key property of the suspension system formed by lateral unit 700, torso support 600 and pelvic support 800 is its accommodation to the patient, allowing the patient the freedom of motion required for gait and balance.

Figure 14:
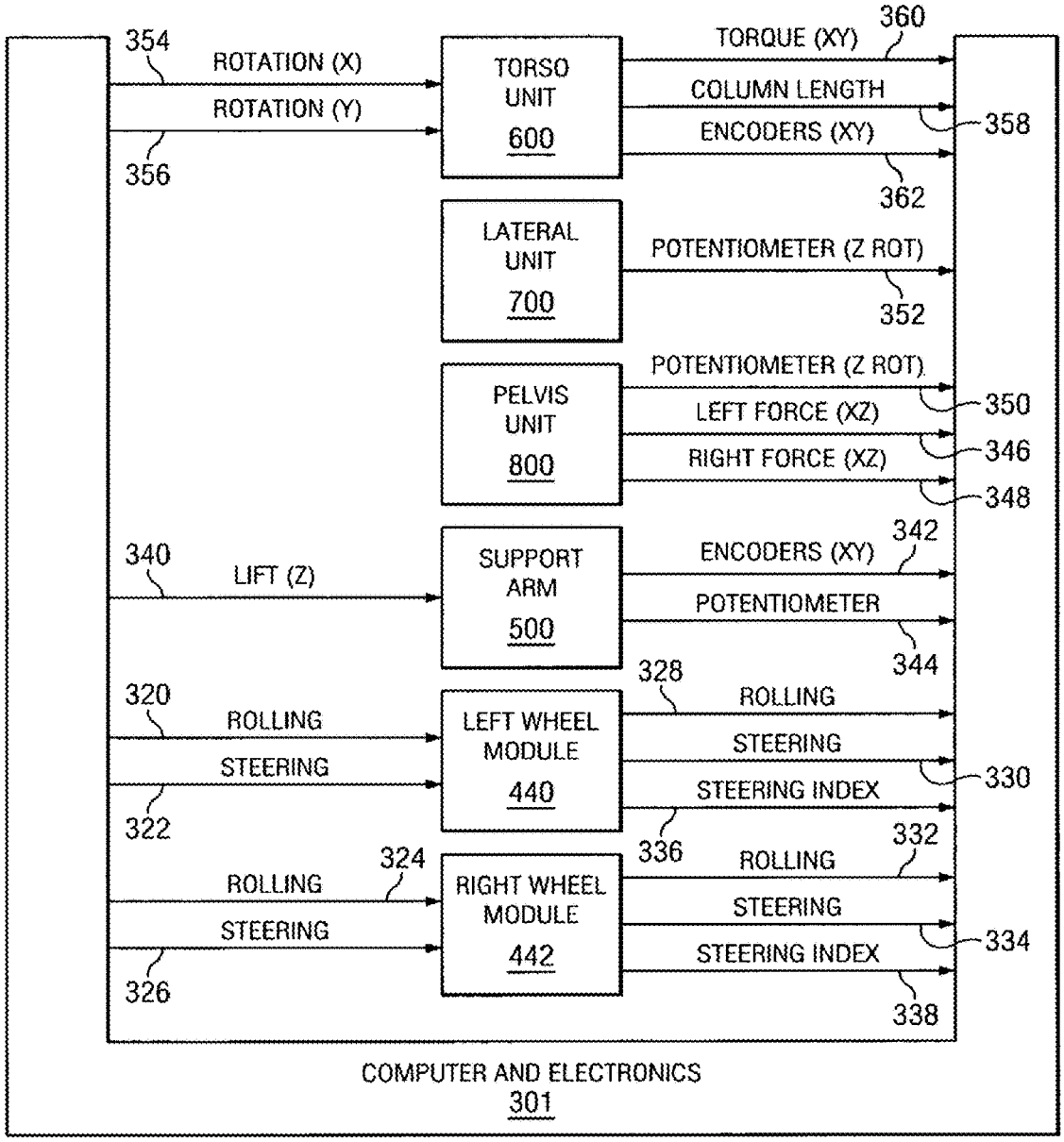
FIG. 14 is a schematic diagram of a control system according to the invention.

FIG. 14 illustrates one possible embodiment of a control system for use with the invention. Electronics 301, which can incorporate a processor, memory, user interface and other elements of a controller or computer, are housed in an electronics enclosure 300 as shown in FIGS. 1-4. The electronics 301 implement the control methods and algorithms of the invention. FIG. 14 shows the basic sensor signal and control paths from the sensors to the control unit or electronics 301, and the control signals from the electronics 301 to each of the motors or other effectors employed by the invention. There are many ways to divide the control methods and algorithms between hardware electronics and software loaded on the computer, and the present invention is not limited to any particular hardware/software implementation.

The left wheel module 440 receives rolling and steering signals 320 and 322 from electronics 301, which transmits similar but independent rolling and steering signals 324 and 326 to the right wheel module 442. These driving signals may represent torque, velocity or position commands. The signals are ultimately transferred by motor amplifiers, in the illustrated embodiment housed within enclosure 300, into currents. In a preferred embodiment all of the described motors are DC servomotors, which send communication signals back to their amplifiers (not shown). Since the close coupling between a motor and its amplifier is well-known, we will simply describe in shorthand fashion a signal, representing torque, velocity or position, as though it drives a motor directly. In the illustrated embodiment, the steering and rolling signals 320-326 are velocity signals.

Signals from the wheel modules 440 and 442 include encoder counts generated by each motor, each of which represent the angle through which the motor has turned. These encoder count signals include rolling and steering signals 328, 330 from left wheel module 440 and rolling and steering signals 332, 334 from right wheel module 442. For each module 440, 442 there is a respective steering index signal 336, 338, which is used by the control unit 301 to establish an absolute steering orientation.

The support arm 500 receives a driving signal 340 to control the raising or lowering of the assembly 506, and thus exert a body weight support function on the patient. Signals from the support arm 500 include an incremental encoder signal 342 from the motor 502, and an absolute measure of displacement 344 generated by potentiometer 510.

In the illustrated embodiment, the pelvis unit 800 includes no actuators itself, but sends several signals to control unit 301. These signals include the X and Z axis forces 346, 348 measured at the patient's hips, as measured by force sensors 810. The potentiometer 812 mounted on one of the pivots of the parallelogram linkage 818 measures the angle of parallelogram linkage 818 and generates signal 350 back to the control unit 301. These signals can accompany other signals, such as signals encoding the entire rotation of the patient's pelvis unit about the X or sagittal axis from potentiometer 722 (FIG. 7) or rotation of the hip pads 801 about the Y or transverse axis.

In the illustrated embodiment, there are no actuators in the lateral unit 700, but unit 700 sends a signal 352 which encodes the lateral displacement along the Y axis allowed by lateral unit 600, which represents the lateral motion of the pelvis unit 800 and torso unit 700, and thus of the patient.

The torso unit 600 receives X and Y rotation signals 354, 356 for its motors 613 (and potentiometer 631), 640 (and potentiometer 630) which rotate column 606 about X axis 638 and Y axis 636, thus rotating the trunk of the patient or exerting a force to counter the patient-generated rotation of the his or her trunk. The control unit 301 receives several signals back from the torso unit 600, including the length of telescoping column 606 (signal 358), the torques about the X and Y axes 638, 636 measured by strain gauges 609 (signal path 360), the potentiometer signal measuring the rotational displacement of revolute slider 602, and the encoder signals from motors 613, 640 (signal path 362).

In the illustrated embodiment, there are seven signals driving motors of the invention, and twenty-three signals communicated from various sensors to the control unit 301. Other kinds of sensors could be used at these or other articulation points. Other aspects of the motion of the mechanical components herein described could be actuated, or those which are now actively actuated or motorized could be made passively movable, or could be locked to one or several positions. The precise number and kind of sensor inputs and driving outputs could vary considerably without departing from the invention.

The preferred embodiment of the present invention is useful in training a patient for balance as a part of walking, and also balance and reaching even when the patient is not moving forward. Among other inputs, the sensor system according to the invention preferably measures each of three signals: X at the hip force sensor 810, Y from the potentiometers 704 on the lateral unit, and rotation about Z, taken from the hip force sensors 810 again. This permits the device 100 to measure any desired three dimensional direction in which the patient wants to move, and to translate these measurements into motion of the device in any planar direction.

For example, through the wheel modules 400 the device 100 can move directly sideways, can crab walk at an arbitrary angle to the X axis, and can turn device 100 around in place around the patient. This extraordinary degree of maneuverability is enabled by having four powered actuators (two rolling, two steering) in the two wheel modules 400.

Modes of Operation

The device is capable of assisting the therapist with a variety of tasks commonly performed in the course of gait and balance training. These tasks correspond to modes of operation of the device, some of which can be explicitly selected via a user interface (not shown) of the control unit 301, while others are invoked transparently based on sensory information. These modes include the following:

Over Ground Walker

The device moves, including both translation and rotation, in response to motion and forces of the patient. The various sensors described above are used to determine the motion or force of the patient, indicating a patient's intention to move or turn in a desired direction, and the wheel modules 400 are commanded in such a way as to allow the patient's motion in a desired direction. Alternatively, the motion of the device can be responsive to the commands of the therapist, through a keyboard, other graphical user interface, joystick or other input device—either locally or remotely.

Trunk/Pelvis Re-Aligner

Figure 15:
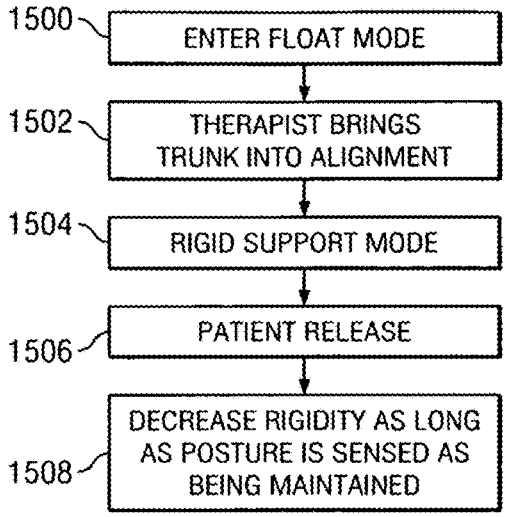
FIG. 15 is a process diagram illustrating steps in trunk/pelvis stabilizer mode of operation of the invention.

The pelvis and trunk supports 800, 600, controlled by the therapist with aid of the above-described sensors, are used to supply the necessary forces and torques to bring the patient into postural alignment. A sequence of operation is illustrated in FIG. 15. At step 1500, the therapist enters the device into a float mode during which no forces are applied. Once that is established the therapist brings the patient's trunk into alignment at 1502. Next, the device is made to enter into a rigid support mode at 1504 in which the trunk and pelvis are held in place. At 1506 the therapist releases the patient. At step 1508, the control unit begins a gradual decrease in the stiffening forces that it is applying to the patient, which it will continue as long as it senses that the desired posture of the patient is being maintained within acceptable limits.

Trunk Perturber

In this mode, the device (automatically, according to a prerecorded exercise program loaded into the control unit 301) or the therapist introduces forces intended to challenge the patient's ability to stay upright or in a certain posture. The device can accomplish this by moving the wheels 400 when the patient is stationary or by changing their velocity during walking. In addition, this can be accomplished by the trunk support mechanism by applying force bursts controlled by the therapist. Alternatively, the therapist can simply push or pull the patient at a variety of locations, knowing that the device will catch the patient if he or she cannot maintain balance.

Trunk Pelvis Stabilizer

In this mode, the trunk and pelvis support mechanism apply restoring forces to maintain the upright orientation of the trunk. The stiffness of the support is adjustable by the therapist from fully rigid down to zero.

Trunk Pelvis Catcher; Cone of Safety

Figure 16:
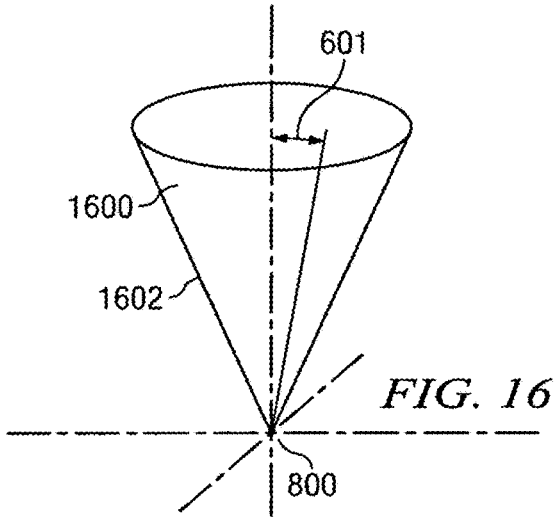
FIG. 16 is a schematic diagram of a "cone of safety" established by one mode of operation of the invention.

The safety function of the trunk support 600 in conjunction with pelvis unit 800 is accomplished by enforcing a "cone of safety" for the patient which is a range of trunk and pelvis excursions. This is simplistically and schematically illustrated at 1600 in FIG. 16. At a boundary 1602 of this range, the trunk support system 600 applies a constraint as communicated to it by the control unit 301, which prevents a fall. The surface 1602 of the conical solid 1600 represents the range of allowable excursions. In FIG. 16, a representative departure of the torso attachment point 601 from its optimum location on the Z axis is shown, which, in one embodiment, would not trigger a torso unit constraint, and in another embodiment would cause a constraint to be applied of less than complete stiffness.

While the "cone of safety" concept is described by way of example in terms of displacement away from the Z axis, the concept extends beyond this. The algorithm may include a monitoring of and response to a rate of angular movement as well as or in addition to displacement, and the deviation from expected norms in either speed or displacement could be measured from some reference other than a vertical axis. For example, the catching function, which results when the "cone" is violated, could be initiated at a torso angle which changes as a function of the over-ground speed. In another example, if the patient's feet (and thus the device) are moving over-ground to the left, the therapist might allow the patient reduced leeway to tip the torso left. Further, the torso information may be combined with sensor input from the pelvis unit to evaluate more completely the state of balance and support of the patient, and to invoke catching and limiting modes only when needed. It should be appreciated that the cone of safety is not necessarily a geometric construct but may be any computation upon the sensor readings.

The range of allowable excursions may be set by the therapist, or may be preset. In the representation of FIG. 16, the "cone of safety" has a circular base but in actual practice the base may be elliptical or other more complex shape, as would be the case if the therapist set a range in the X direction to be more or less than a permissible range of excursion or velocity in the Y direction. Further, the shape need not be symmetrical.

Further, the "cone of safety" may not be hollow with a solid wall of constraint, but may instead gradually thicken toward its perimeter. That is, the torso support 600 may apply an amount of constraint which varies as a function of the degree of torso excursion, such that the patient feels little assistance in the vicinity of vertical trunk orientation, but experiences near-rigid trunk support farther away.

Vertical Catcher

In this mode, the pelvis support 800 prevents the patient from falling down to the floor and catches the patient in a compliant manner. The rate of descent is controlled to a safe and comfortable level.

Body Weight Unloading

The device unloads a therapist-specified amount of the patient's weight in a compliant fashion to facilitate body weight-supported training.

Iso-Kinetic Walker

The device applies a therapist-adjustable amount of resistance in the direction of walking for strength training.

Sit-To-Stand Training

In this mode, the device facilitates sit-to-stand training by assuring that the patient cannot fall, and also by providing body weight support.

Transfer from Sitting

Yet another mode of operation involves transferring the patient from a sitting position, e.g., in a wheelchair, into the device. This makes use of the lifting mechanism, which goes low enough to connect to a seated patient, and is strong enough to fully lift the patient. The arms 803 of the pelvis support unit 800 are capable of swinging out of the way (as by removing pins 807A) so that the patient can be "transferred" laterally.

Figure 17:
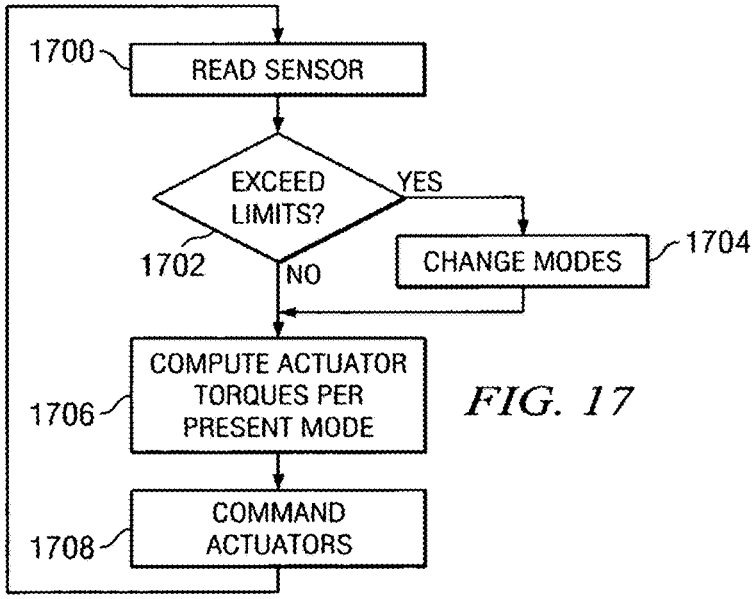
FIG. 17 a schematic and representative flow diagram of the "cone of safety" mode of operation.

All of the aforementioned modes are implemented by a similar control framework, schematically illustrated in FIG. 17. The various sensor readings are input at 1700 by the control computer 301, and compared at 1702 to a limit function which implements the cone of safety. Depending on this comparison the control mode may be changed at 1704 to accomplish a catching or limiting function. Actuator torques are then computed at 1706 and commanded at 1708 to the various actuators.

While the present invention has been described in terms of a mobile apparatus, it also has application to stationary devices. For example, a device according to the invention could be used over a treadmill and in this instance would not need wheels.

In summary, patient-responsive physical therapy apparatus has been described which independently supports the pelvis and torso of the patient. The exercise device permits natural movements of the pelvis and torso occurring during a walking gait and provides support for a selected portion of the patient's weight. Among many other modes of operation, the device can be used to prevent torso excursions or velocities beyond a predetermined cone of safety, to challenge the balance of the patient, and to permit the patient to attempt to correct for a fall before intervening.

While various embodiments of the present invention have been described in the above description and illustrated in the appended drawings, the present invention is not limited thereto but only by the scope and spirit of the appended claims.

What is claimed is:

1. A physical therapy device for assisting a patient in walking and balance comprising:

a base;

a pelvis support unit for fitting to the pelvis of a patient, the pelvis support unit coupled to the base through a first powered articulation;

a torso support unit for fitting to the torso of the patient coupled to the base through a second powered articulation; and a control unit coupled to the first and second powered articulations to selectively move the pelvis support unit and the torso support unit relative to the base.

2. The apparatus of claim 1 wherein the torso support includes a telescoping column coupling the torso support unit to the base, the telescoping column operable to increase or decrease the distance from the torso support unit to the pelvis support unit.

3. The apparatus of claim 1 wherein the pelvis support unit articulates to allow transverse motion of the pelvis.

4. The apparatus of claim 1 wherein the pelvis support unit rotates to allow rotation of the pelvis.

5. The apparatus of claim 4 wherein the pelvis support unit further includes at least one sensor for measuring the rotation of the pelvis and the control unit is coupled to the sensor for receiving a signal encoding the rotation.

6. The apparatus of claim 5 wherein the pelvis support unit further includes at least one sensor for measuring a torque around the axis of the rotation and the control unit is coupled to the sensor for receiving a signal encoding the torque sensed by the sensor.

7. The apparatus of claim 1, and further comprising:

at least one sensor for sensing torque or angular displacement at the first powered articulation, the control unit being coupled to the sensor for receiving a signal encoding the last torque or angular displacement; and at least one actuator for applying a selected torque at the first powered articulation, the actuator coupled to the control unit for being actuated responsive to the signal, the control unit periodically monitoring the signal and comparing the encoded torque or angular displacement to a reference, the control unit actuating the actuator to exert a torque in opposition to the encoded torque or angular displacement in mitigation of the patient falling.

8. The apparatus of claim 1 including a treadmill, the support units being positioned over the treadmill.

9. An apparatus for providing physical therapy exercise to a patient comprising:

a base;

a pelvis support unit for fitting to the pelvis of the patient, the pelvis support unit coupled to the base and having a first actuator for selectively applying force to the pelvis support unit in a vertical direction relative to the base;

a torso support unit for fitting to the torso of the patient, the torso support unit coupled to the base and having a powered articulation actuable about at least one axis relative to the base, the articulation being independent of the first actuator of the pelvis support unit;

sensors associated with the pelvis support unit and the torso support unit to sense the position of the pelvis support unit and the torso support unit relative to the base; and a control unit coupled to the sensors and to the first actuator of the pelvis support unit and the powered articulation of the torso support unit to selectively apply a force or torque to the pelvis support unit and the torso support unit relative to the base.

10. The apparatus of claim 9 including a treadmill, the support units being positioned over the treadmill.

11. The apparatus of claim 9 wherein the first actuator of the pelvis support unit is also coupled to the torso support unit to selectively apply force to the torso support unit in a vertical direction relative to the base.

12. The apparatus of claim 9 wherein the base includes an upstanding support arm and a lateral unit extending horizontally from the upstanding support arm attached to the pelvis support unit, the first actuator coupling the lateral unit to the support arm to apply vertical force to the pelvis support unit and the lateral unit relative to the support arm.

13. The apparatus of claim 9 wherein the first actuator of the pelvis support unit is operable by the control unit to apply a selected amount of vertical force in opposition to the force of gravity.

14. The apparatus of claim 9 wherein the powered articulation of the torso support unit is operable by the control unit to apply a selected amount of torque around an axis of articulation in a selected angular direction.

15. The apparatus of claim 9 wherein the pelvis support unit includes a flexible pelvis harness affixable around the pelvis of the patient and the torso support unit includes a flexible torso harness affixable to an upper portion of a torso of the patient.

16. An apparatus for providing physical therapy to a patient comprising:

a base;

a torso support system coupled to the base affixable to an upper part of a torso of the patient, the torso support system having a powered articulation actuable around at least two axes of motion relative to the base;

sensors associated with the torso support unit for sensing the spatial position of the torso support unit; and a control unit coupled to the sensors and the powered articulation for selectively applying a torque of a selected magnitude around one or both axes of rotation in selected angular directions.

17. The apparatus of claim 16 including a treadmill, the torso support unit being positioned over the treadmill.

18. An apparatus for providing physical therapy exercise to a patient comprising:

a base;

a pelvis support unit for fitting to the pelvis of a patient for supporting a portion of the patient's weight in a vertical direction; and a parallelogram linkage coupling the pelvis support unit to the base, the parallelogram linkage permitting rotation of the patient's pelvis in a plane orthogonal to the vertical direction.

19. The apparatus of claim 18 including a treadmill, the pelvis support unit being positioned over the treadmill.

20. The apparatus of claim 18 including a first actuator for selectively applying force to the pelvis support unit in a vertical direction relative to the base.

* * * * *